US010287764B2

(12) United States Patent
Nakashima et al.

(10) Patent No.: US 10,287,764 B2
(45) Date of Patent: May 14, 2019

(54) FLUSH TOILET

(71) Applicant: TOTO LTD., Kitakyushu-shi, Fukuoka (JP)

(72) Inventors: Takahiro Nakashima, Kitakyushu (JP); Nobuhiro Hayashi, Kitakyushu (JP); Hidekazu Kitaura, Kitakyushu (JP); Haruka Saito, Kitakyushu (JP); Isami Sakaba, Kitakyushu (JP)

(73) Assignee: TOTO LTD., Fukuoka (JP)

( * ) Notice: Subject to any disclaimer, the term of this patent is extended or adjusted under 35 U.S.C. 154(b) by 10 days.

(21) Appl. No.: 15/698,948

(22) Filed: Sep. 8, 2017

(65) Prior Publication Data

US 2018/0073230 A1 Mar. 15, 2018

(30) Foreign Application Priority Data

Sep. 14, 2016 (JP) ..... 2016-179772
Sep. 14, 2016 (JP) ..... 2016-179773
Jul. 19, 2017 (JP) ..... 2017-140084

(51) Int. Cl.

| | |
|---|---|
| ***E03D 1/22*** | (2006.01) |
| ***E03D 11/13*** | (2006.01) |
| ***E03D 11/16*** | (2006.01) |
| ***E03D 1/26*** | (2006.01) |
| *E03D 3/12* | (2006.01) |
| *E03D 11/18* | (2006.01) |

(52) U.S. Cl.

CPC ..... *E03D 1/22* (2013.01); *E03D 1/26* (2013.01); *E03D 11/13* (2013.01); *E03D 11/16* (2013.01); *E03D 3/12* (2013.01); *E03D 11/18* (2013.01)

(58) Field of Classification Search

CPC ..... E03D 11/16; E03D 11/17; E03D 11/08
USPC ..... 4/420, 252.1
See application file for complete search history.

(56) References Cited

U.S. PATENT DOCUMENTS

2012/0284911 A1* 11/2012 Kamiya ..... E03D 11/08 4/420

FOREIGN PATENT DOCUMENTS

JP 2011-179187 A 9/2011

* cited by examiner

*Primary Examiner* — Lauren A Crane
(74) *Attorney, Agent, or Firm* — Studebaker & Brackett PC

(57) ABSTRACT

Problem:
Provided is a flush toilet capable of increasing the volume of a waste conveyance flow, thereby improving a waste conveyance capability.
Solution:
The flush toilet includes: a toilet main unit (2) comprising a discharge conduit (16) communicated with the discharge trap pipe. The discharge conduit includes a flow dividing section (26) provided on a downstream side of an upstream discharge conduit section, and a delaying flow passage (28) branched from the flow dividing section. An inward region of the skirt portion includes: a central region (D) and a lateral region (E). The delaying flow passage (28) forms a passage in the lateral region (E) and merges leading flush water having flowed into the delaying flow passage from the flow dividing section (26) with a flush water flow reaching the flow dividing section at a timing after the inflow of the flush water to the delaying flow passage.

11 Claims, 14 Drawing Sheets

UP
DOWN
FRONT
REAR
1
2
4
6
8
8a
8b
8c
8d
8e
8f
9
10
12
14
16
18
20
20a
22
24
26
28
30
32
34b
36
B0
B1
B1'
B2
B3
B4
A5
A6
C
F
Wo

FLUSH TOILET

TECHNICAL FIELD

The present invention relates to a flush toilet, and more particularly to a flush toilet designed to be flushed using flush water to discharge waste.

BACKGROUND ART

Heretofore, there has been known a discharge socket for connecting a drain passage of a toilet main unit of a flush toilet and an underfloor drain pipe, as disclosed in Patent Document 1 (JP 2011-179187A). This discharge socket has: a toilet main unit-side connecting pipe member configured to be connected to an outlet of the drain passage of the toilet main unit; an underfloor-side connecting pipe member configured to be connected to an inlet of the underfloor drain pipe; and an approximately linearly-extending intermediate pipe member connecting the toilet main unit-side connecting pipe member and the underfloor-side connecting pipe member.

In a flush toilet equipped with this discharge socket, when toilet flushing is started to discharge waste in a bowl portion from a toilet main unit, part of flush water stored in the bowl portion firstly flows, as leading flush water flowing on a leading side of the waste, from a drain passage into the discharge socket and then flows toward a building sewer pipe. Subsequently, a flow of flush water flowing mainly on a trailing side of the waste to convey the waste, i.e., a waste conveyance flow, flows into the discharge socket and then flows toward the building sewer pipe together with the waste.

SUMMARY OF INVENTION

Technical Problem

Meanwhile, the flush toilet as described in the Patent Document 1 is requested to reduce the volume of flush water to be used per toilet flushing cycle, in order to cope with demand for water-saving. In this case, the volume of the waste conveyance flow flowing on the trailing side of the waste to convey the waste will also be reduced. The reduction in volume of the waste conveyance flow causes a problem of deterioration in waste conveyance capability (capability of conveying waste), e.g., a reduction in distance over which it is possible to convey waste through a transversely-extending conduit.

The present invention has been made to solve the above conventional problem, and an object thereof is to provide a flush toilet capable of increasing the volume of a waste conveyance flow for washing down waste, even when the volume of flush water for toilet flushing is reduced in order to cope with demand for water-saving, thereby improving a waste conveyance capability.

Solution to Problem

In order to achieve the above object, the present invention provides a flush toilet designed to be flushed using flush water to discharge waste. The flush toilet comprises: a toilet main unit comprising a bowl portion for receiving waste, a discharge trap pipe extending from a bottom of the bowl portion, and a skirt portion provided to cover the bowl portion and the discharge trap pipe from a lateral side thereof; and a discharge conduit communicated with the discharge trap pipe. The discharge conduit comprises: an upstream discharge conduit section; a flow dividing section provided on a downstream side of the upstream discharge conduit section; a downstream discharge conduit section provided on a downstream side of the flow dividing section; and a delaying flow passage branched from the flow dividing section. In top plan view, an inward region of the skirt portion comprises: a central region extending on an inner side of a width of the discharge trap pipe in a direction orthogonal to the direction connecting the inlet and the outlet of the discharge trap pipe; and a lateral region on a lateral side of the central region. The delaying flow passage of the discharge conduit is formed in the lateral region in the skirt portion and merges flush water having flowed into the delaying flow passage from the flow dividing section with a flush water flow reaching the flow dividing section at a timing after the inflow of the flush water to the delaying flow passage.

In the flush toilet of the present invention having the above feature, during toilet flushing, the flow dividing section enables at least part of relatively low-speed flush water flowing on a leading side of the waste (hereinafter referred to occasionally as "low-speed leading flush water" or "leading flush water") to flow into the delaying flow passage, and the delaying flow passage enables flush water having flowed into the delaying flow passage to merge with a flow of the relatively high-speed flush water for washing down or convey the waste (hereinafter referred to occasionally as "high-speed waste conveyance flow" or "waste conveyance flow"), which reaches the flow dividing section at a timing after the inflow of the flush water to the delaying flow passage. In this process, the delaying flow passage forms a flow passage in the lateral region between the discharge trap pipe and the skirt portion, so that it is possible to expand the delaying flow passage to a wider region on the side of the lateral region to increase a bottom surface area of the delaying flow passage. This can make it easier to enable the leading flush water to flow into the delaying flow passage in a larger volume. Therefore, even in a situation where the volume of flush water is reduced in order to cope with demand for water-saving, the flush toilet of the present invention can enable leading flush water to flow out through the delaying flow passage in a larger volume so as to merge with a waste conveyance flow, i.e., can increase the volume of the waste conveyance flow, thereby improving a capability of conveying waste (waste conveyance capability).

In the case where, due to difficulty in forming the delaying flow passage in the lateral region, the delaying flow passage is formed only in the central region, i.e., it is impossible to increase the bottom surface area toward a lateral side, it is conceivable to form the delaying flow passage in such a manner as to expand an internal space thereof in an upward-downward direction, to thereby increase the volume of flush water flowing through the delaying flow passage. In this case, however, when the flow speed of flush water flowing into the delaying flow passage is fairly small, it is difficult to raise a water level, i.e., increase the volume of flush water flowing through the delaying flow passage. In the flush toilet of the present invention, by forming the delaying flow passage in the lateral region to increase the bottom surface area of the delaying flow passage in the lateral region, it becomes possible to more reliably increase the volume of flush water flowing through the delaying flow passage, irrespective of the flow speed of inflowing flush water. This makes it possible to enable the leading flush water to flow out through the delaying flow passage in a larger volume so as to merge with the waste conveyance flow.

Preferably, in the flush toilet of the present invention, the delaying flow passage comprises a connection zone connecting with the flow dividing section, and an extended flow passage extending from the connection zone toward the lateral region, wherein the connection zone forms a bent flow passage for changing a flow direction of flush water having flowed into the connection zone from the flow dividing section, toward the lateral region.

According to this feature, the connection zone enables the flow direction of flush water having flowed into the connection zone from the flow dividing section to be changed toward the lateral region, so that it is possible to reduce the flow speed of the leading flush water flowing through the extended flow passage, and increase a period of time during which the leading flush water flows through the extended flow passage. This makes it possible to suppress a situation where the leading flush water having flowed into the delaying flow passage flows out to the flow dividing section before the waste conveyance flow reaches the flow dividing section. Thus, it becomes possible to enable the leading flush water to flow out through the delaying flow passage in a larger volume so as to more reliably merge with the waste conveyance flow.

Preferably, in the above flush toilet, the extended flow passage is provided in each of a first side region and a second side region of the lateral region on both lateral sides of the central region.

According to this feature, the extended flow passage provided in each of the first and second side regions of the lateral region on both lateral sides of the central region can expand the delaying flow passage to a wider region on the side of the lateral region to increase the bottom surface area of the delaying flow passage. This can make it easier to enable the leading flush water to flow into the delaying flow passage in a larger amount.

Preferably, in the above flush toilet, the extended flow passage extends in a direction along the direction connecting the inlet and the outlet of the discharge trap pipe.

According to this feature, the extended flow passage extends in a direction along the direction connecting the inlet and the outlet of the discharge trap pipe, so that it is possible to expand the delaying flow passage to a wider region on the side of the lateral region to further increase the bottom surface area of the delaying flow passage. This can make it easier to enable the leading flush water to flow into the delaying flow passage in a larger amount.

Preferably, in the above flush toilet, the extended flow passage extends to reach a position where the extended flow passage partially overlaps the discharge trap pipe, in side view.

According to this feature, the extended flow passage extends to reach a position where the extended flow passage partially overlaps the discharge trap pipe, in side view, so that it is possible to expand the delaying flow passage to a wider region on the side of the lateral region to further increase the bottom surface area of the delaying flow passage. This can make it easier to enable the leading flush water to flow into the delaying flow passage in a larger amount.

Preferably, in the above flush toilet, the flow dividing section of the discharge conduit forms a downward flow passage extending in an upward-downward direction, wherein the connection zone of the delaying flow passage is connected to part of the downward flow passage of the flow dividing section on the side of a rise path of the discharge trap pipe.

According to this feature, during toilet flushing, during toilet flushing, when the high-speed waste conveyance flow flows from the rise path of the discharge trap pipe into the downward flow passage of the flow dividing section, the waste conveyance flow flows down through part of a peripheral wall of the downward flow passage on a side opposite to the rise path of the discharge trap pipe, because the momentum of the high-speed waste conveyance flow is relatively strong. On the other hand, during toilet flushing, the low-speed leading flush water flows down through the remaining part of the peripheral wall of the downward flow passage on the side of the rise path of the discharge trap pipe, because the momentum of the low-speed flush water is relatively weak. This can make it less likely for the waste conveyance flow to flow into the delaying flow passage, while selectively enabling the low-speed leading flush water to flow into the delaying flow passage in a more reliable manner.

Preferably, in the above flush toilet, the delaying flow passage has an exit separately from the connection zone, wherein the delaying flow passage merges flush water having flowed into the delaying flow passage from the connection zone, from the exit with a flush water flow reaching the flow dividing section at a timing after the inflow of the flush water to the delaying flow passage According to this feature, differently from the structure in which the connection zone additionally function as an exit of the delaying flow passage, it is not necessary to enable flush water to return to and flow out through the connection zone, so that it is possible to suppress a situation where a non-flowing state of flush water within the extended flow passage continues for a relatively long period of time. More specifically, it is possible to suppress the occurrence of a situation where a non-flowing state of flush water within the extended flow passage continues for a relatively long period of time and thus a timing of the outflow is delayed to an extent that the flush water cannot merge with the waste conveyance flow. Thus, even when the volume of flush water for toilet flushing is reduced in order to cope with demand for water-saving, it is possible to enable the leading flush water to flow out through the delaying flow passage in a larger volume so as to merge with the conveyance flow. This makes it possible to increase the volume of the waste conveyance flow, thereby improving the waste conveyance capability. Further, it becomes possible to suppress a situation where, due to the non-flowing state of flush water within the extended flow passage, floating pieces of waste sink in the flush water and remain in the extended flow passage.

Preferably, in the above flush toilet, the delaying flow passage has an exit separately from the connection zone, wherein the delaying flow passage merge flush water having flowed into the delaying flow passage from the connection zone, from the exit with a flush water flow reaching the flow dividing section at a timing after the inflow of the flush water to the delaying flow passage, and the extended flow passage comprises a first extended flow passage provided in one of the first and second side regions of the lateral region, and a second extended flow passage provided in the other side region of the lateral region, and wherein the exit comprises a first exit forming an exit of the first extended flow passage, and a second exit forming an exit of the second extended flow passage, and wherein the first extended flow passage extending from the connection zone to the first exit and the second extended flow passage extending from the connection zone to the second exit are formed independently of each other.

According to this feature, the first extended flow passage extending from the connection zone to the first exit and the second extended flow passage extending from the connection zone to the second exit are formed independently of each other. This makes it possible to suppress a situation where a turbulent flow occurs due to merging of respective flush water flows in the first and second extended flow passages, and the non-flowing state of flush water within the extended flow passages continues for a relatively long period of time.

Preferably, in the above flush toilet, the discharge conduit is a resin member which is a separate component from the toilet main unit.

According to this feature, the discharge conduit is a resin member which is a separate component from the toilet main unit. Thus, for example, comparing with case where the discharge conduit is made of a ceramic material, it becomes possible to reduce a manufacturing error, and more reliably install the delaying flow passage in the lateral region.

Preferably, in the above flush toilet, the extended flow passage is provided only in the lateral region.

According to this feature, the extended flow passage is provided only in the lateral region. The extended flow passage disposed in the lateral region becomes less likely to receive restrictions from the shape of the discharge trap pipe and the position of an inlet of the building sewer pipe to be connected to the discharge conduit. Thus, according to this feature, it becomes possible to apply the extended flow passage to various types of flush toilets adaptable to differences in the shape of the discharge trap pipe and the position of the inlet of the building sewer pipe.

Preferably, in the above flush toilet, the downstream discharge conduit section comprises a transverse flow passage extending in a transverse direction to a position corresponding to a building sewer pipe, wherein the connection zone and an exit of the delaying flow passage are opened to the flow dividing section located upstream of the transverse flow passage of the downstream discharge conduit section.

According to this feature, the connection zone and an exit of the delaying flow passage are opened to the flow dividing section located upstream of the transverse flow passage of the downstream discharge conduit section, so that it is possible to cope with differences in the position of the inlet of the building sewer pipe by changing only the length of the transverse flow passage depending on the position of the inlet of the building sewer pipe, without changing the length of the delaying flow passage.

Advantageous Effects of Invention

The flush toilet of the present invention is capable of increasing the volume of the waste conveyance flow even when the volume of flush water is reduced in order to cope with demand for water-saving, thereby improving the waste conveyance capability.

DESCRIPTION OF EMBODIMENTS

With reference to the accompanying drawings, a flush toilet according to a first embodiment of the present invention will now be described.

Figure 1A:
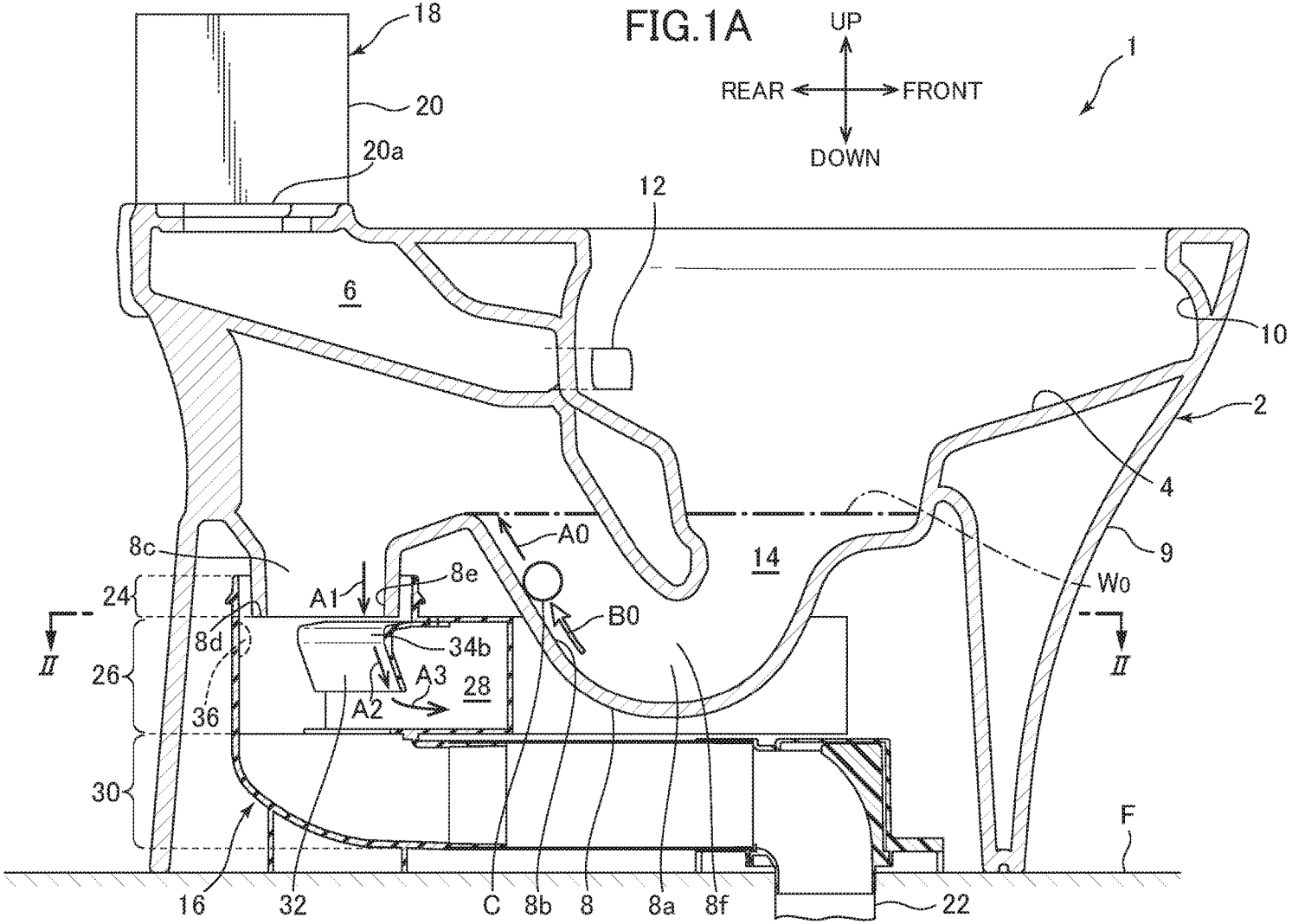
FIG. 1A is a vertical sectional view depicting a flush toilet according to a first embodiment of the present invention, wherein a state of leading flush water flowing on a leading side of waste, is indicated.
Figure 2:
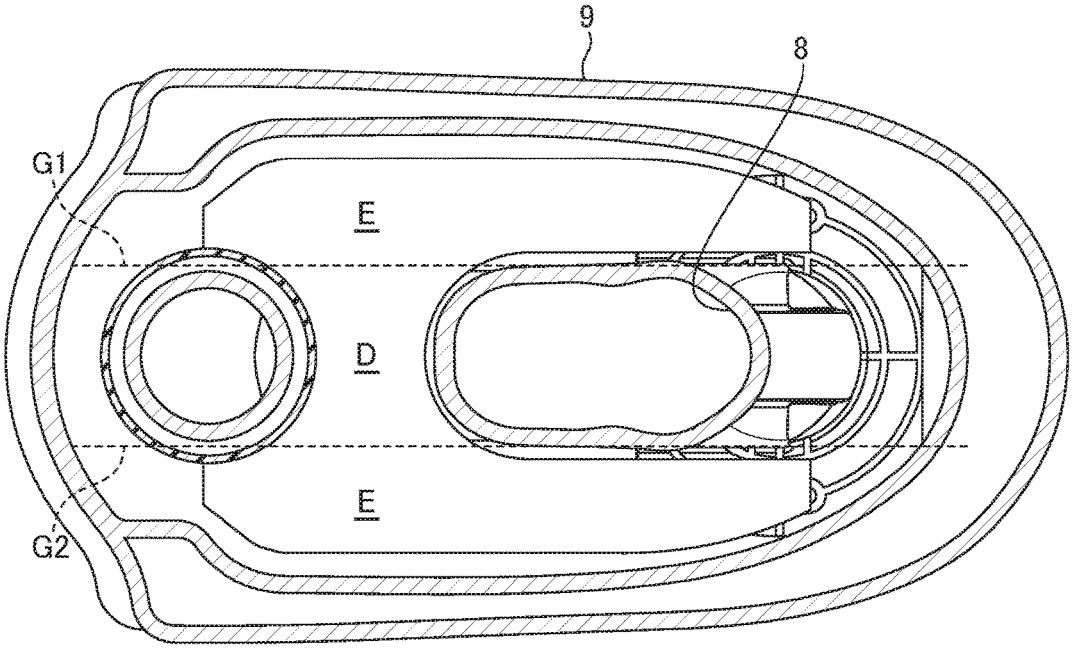
FIG. 2 is a sectional view taken along the line II-II in FIG. 1A.

First of all, a flush toilet according to a first embodiment of the present invention will be described with reference to FIG. 1A and FIG. 2. FIG. 1A is a vertical sectional view depicting the flush toilet according to the first embodiment, wherein a state of leading flush water, i.e., flush water flowing on a leading side of waste, is indicated, and FIG. 2 is a sectional view taken along the line II-II in FIG. 1A.

As depicted in FIG. 1A, the flush toilet 1 comprises a toilet main unit 2 which has: a bowl portion 4 formed on a front side of an upper end thereof; a water conducting passage 6 on a rear side of the upper end; and a discharge trap pipe 8 formed beneath the water conducting passage 6 and the bowl portion 4 to extend from a bottom end of the bowl portion 4. The bowl portion 4 is formed in a bowl-like shape, and configured to receive waste therein. The flush toilet 1 is a water-saving wash-down type flush toilet designed to perform toilet flushing, for example, using 3.8 to 6-liter flush water.

Although the flush toilet 1 according to the first embodiment will be described based on an example where the present invention is applied to a floor-mounted wash-down type flush toilet, it is to be understood that the present invention is also applicable to any other suitable type of flush toilet, such as a wall-hung flush toilet or a siphon-type flush toilet configured to generate siphonage.

It should be noted that any embodiment of the present invention will be described based on the following assumption: an upper side and a lower side of the drawing sheet of FIG. 1A are defined, respectively, as a front side and a rear side of the toilet main unit 2, and a right side and a left side when viewing the toilet main unit 2 rearwardly from the front side thereof are defined, respectively, as a right side and a left side of the toilet main unit 2.

The bowl portion 4 of the toilet main unit 2 has an overhang-shaped rim 10 formed on an inner side of an upper edge region thereof, and a rim spout port 12 opened in a part of the rim 10 to spout flush water supplied from the water conducting passage 6, wherein the bowl portion 4 is configured to be cleaned or flushed with flush water swirlingly flowing downwardly after being spouted from the rim spout port 12.

The bowl portion 4 has a lower region formed as a water pooling region 14, wherein an accumulated water surface $W_0$ of pooled water is indicated by one-dot chain line. The discharge trap pipe 8 comprises an inlet path 8*a* connected to the bottom end of the bowl portion 4, a rise path 8*b* extending obliquely upwardly and rearwardly from a downstream end of the inlet path 8*a*, and a fall path 8*c* descending from a downstream end of the rise path 8*b*. The bowl portion 4 and the discharge trap pipe 8 are made of a ceramic material, and integrally molded with the toilet main unit 2. The inlet path 8*a* forms an inlet 8*f* of the discharge trap pipe 8.

The flush toilet 1 further comprises a flush water tank unit 18 provided on an upper side of the water conducting passage 6 of the toilet main unit 2 and configured to store therein flush water to be supplied to the toilet main unit 2. The flush water tank unit 18 comprises a flush water tank 20 storing therein flush water. This flush water tank 20 has a bottom wall surface formed with a discharge port 20*a* selectively communicatable with the water conducting passage 6 of the toilet main unit 2 so as to discharge flush water stored in the flush water tank 20.

As depicted in FIG. 2, the toilet main unit 2 further comprises a skirt portion 9 provided to cover the bowl portion 4 and the discharge trap pipe 8 from a lateral side thereof. The skirt portion 9 is an exterior wall formed around the entire outer periphery of the toilet main unit 2. The skirt portion 9 is formed to extend from an upper end of the toilet main unit 2 to a floor F. Thus, the skirt portion 9 covers an outer side of the bowl portion 4, the discharge trap pipe 8 and an aftermentioned discharge socket 16.

In top plan view, an inward region of the skirt portion 9 comprises: a central region D extending in a forward-rearward (longitudinal) direction (a direction connecting the inlet 8*f* and an outlet 8*d* of the discharge trap pipe 8) as a region on an inner side with respect to a width of the discharge trap pipe 8 in a rightward-leftward (lateral) direction (a direction orthogonal to the direction connecting the inlet 8*f* and the outlet 8*d* of the discharge trap pipe 8); and a lateral region E on both sides of the central region D. The central region D is a rectangular parallelepiped-shaped spatial region extending inside the skirt portion 9 from the bottom end to the upper end of the toilet main unit 2 with a width approximately equal to that of the discharge trap pipe 8. More specifically, the central region D is a region surrounded by the dotted lines G1, G2, and front and rear ends of the skirt portion 9, in top plan view. The lateral region E consists of two spatial regions each extending inside the skirt portion 9 from the bottom end to the upper end of the toilet main unit 2 on a respective one of the right and left sides of the central region D. More specifically, the lateral region E consists of a first side region surrounded by the dotted line G1 and part of the skirt portion 9 outside the dotted line G1, and a second side region surrounded by the dotted line G2 and part of the skirt portion 9 outside the dotted line G2, in top plan view.

Figure 3:
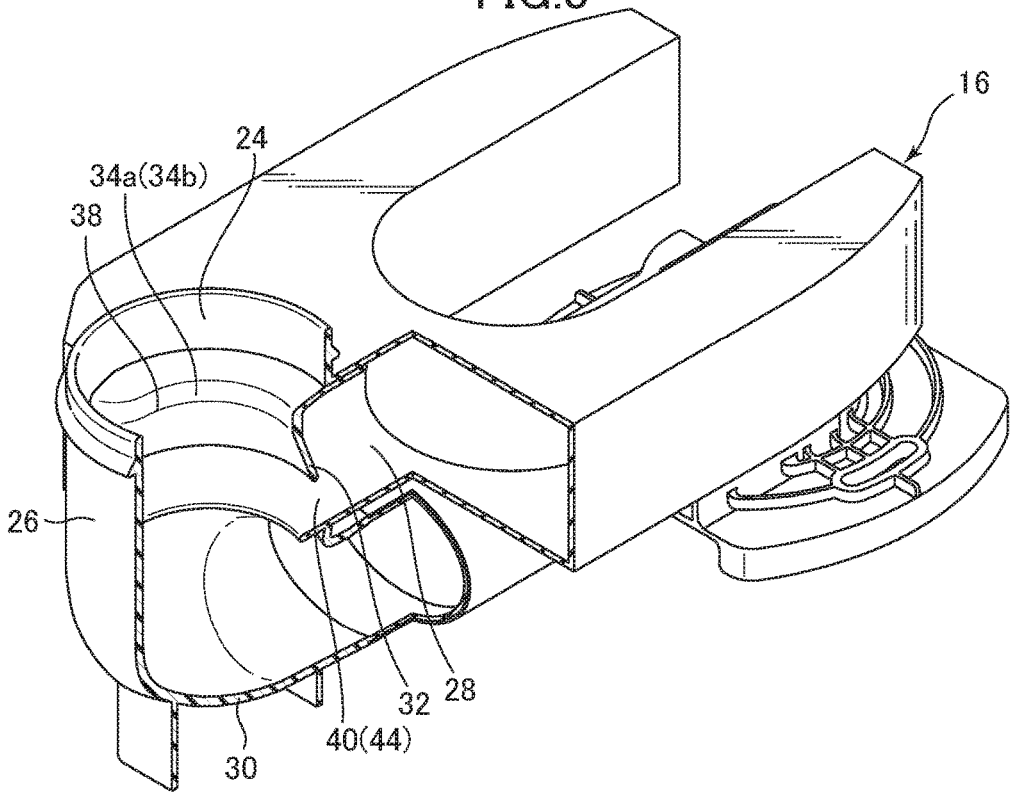
FIG. 3 is an enlarged perspective view depicting an internal structure of a discharge socket in the flush toilet according to the first embodiment depicted in FIG. 1A, wherein a vicinity of a flow dividing section of the discharge socket is partially cut away.
Figure 4:
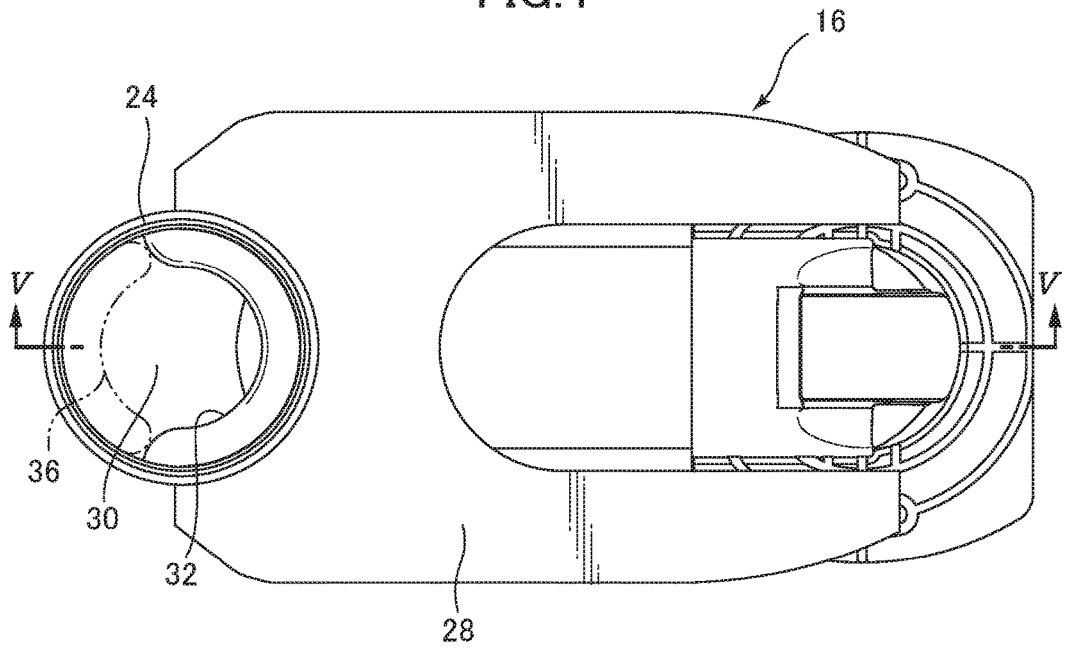
FIG. 4 is a top view depicting the discharge socket of the flush toilet according to the first embodiment.
Figure 5:
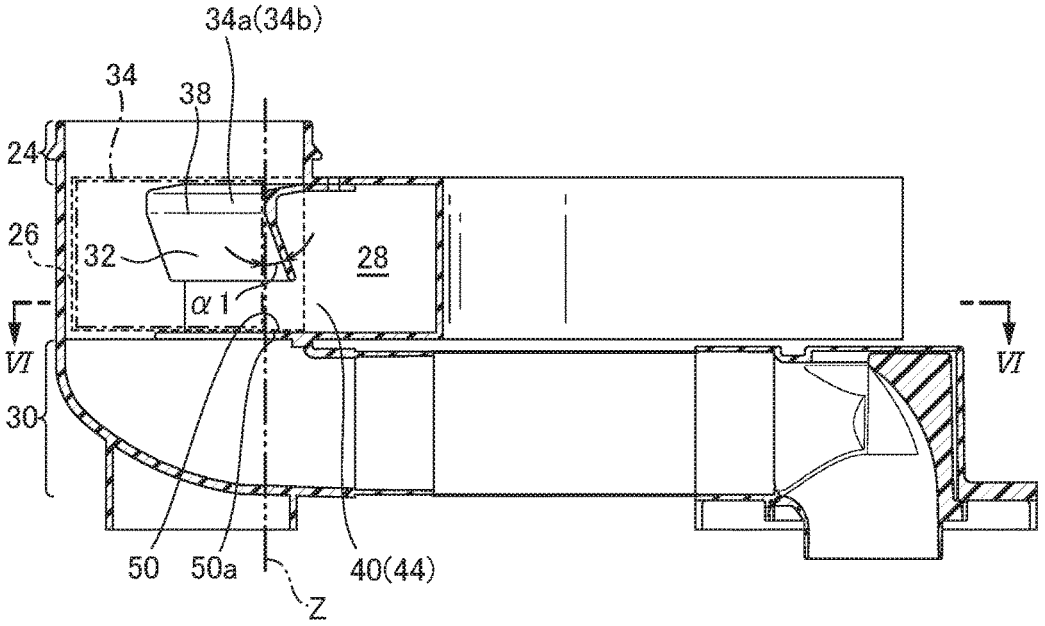
FIG. 5 is a sectional view taken along the line V-V in FIG. 4.
Figure 6:
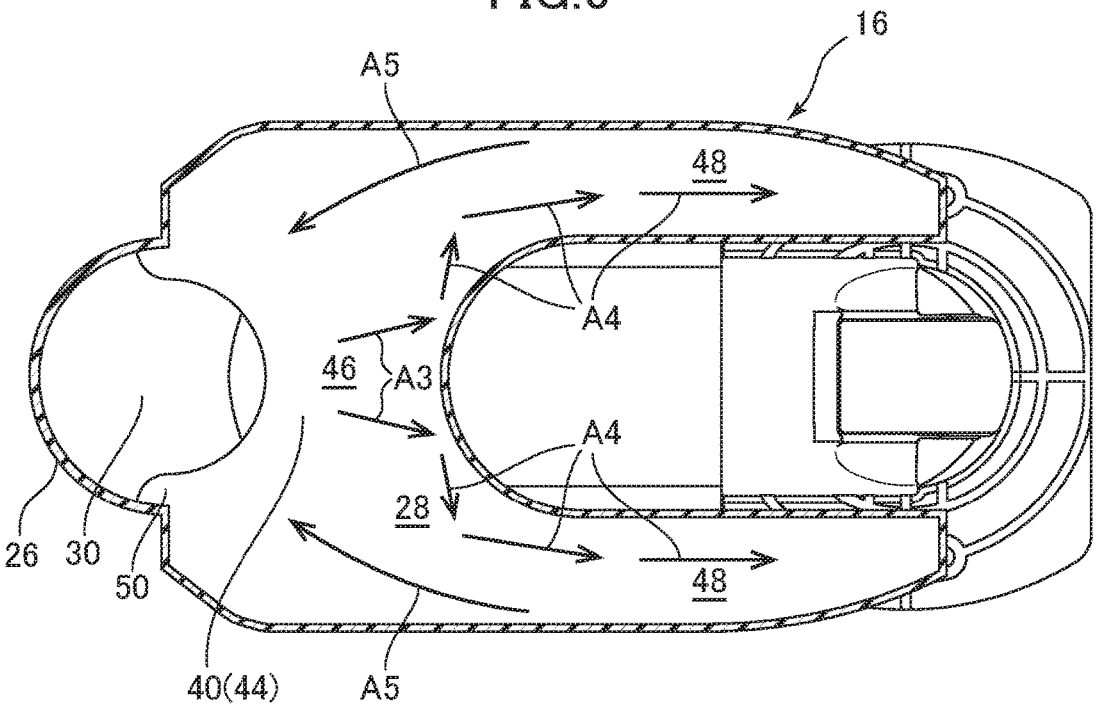
FIG. 6 is a sectional view depicting the discharge socket of the flush toilet according to the first embodiment, taken along the line VI-VI in FIG. 5.

With reference to FIGS. 3 to 6, a configuration of a discharge socket (a discharge device) 16 of the flush toilet 1 according to the first embodiment will be described in detail below. FIG. 3 is an enlarged perspective view depicting an internal structure of the discharge socket in the flush toilet according to the first embodiment depicted in FIG. 1A, wherein a vicinity of a flow dividing section of the discharge socket is partially cut away, and FIG. 4 is a top view depicting the discharge socket of the flush toilet according to the first embodiment. FIG. 5 is a sectional view taken along the line V-V in FIG. 4, and FIG. 6 is a sectional view depicting the discharge socket of the flush toilet according to the first embodiment, taken along the line VI-VI in FIG. 5.

The flush toilet 1 further comprises a discharge socket 16 which is a drain duct communicated with the discharge trap pipe 8 and configured to discharge waste to a building sewer pipe 22 on a downstream side thereof.

The discharge socket 16 comprises an upstream discharge conduit section 24, a flow dividing section 26, a delaying flow passage 28, and a downstream discharge conduit section 30, which are arranged approximately in this order in a direction from an upstream end to a downstream end thereof. The discharge socket 16 is a resin member which is a separate component from the toilet main unit 2.

The upstream discharge conduit section 24 has an upstream end connected to the outlet 8*d* of the discharge trap pipe 8 (i.e., outlet 8*d* of the fall path 8*c*), and extends approximately parallel to the outlet 8*d* and vertically downwardly. The upstream discharge conduit section 24 extends from a position outside and above the outlet 8*d* of the fall path 8*c* to a position adjacent to and below the outlet 8*d*.

The downstream discharge conduit section 30 is provided on a downstream side of the flow dividing section 26. The downstream discharge conduit section 30 forms a transverse flow passage which extends linearly in a transverse direction to reach a position corresponding to the building sewer pipe 22. The downstream discharge conduit section 30 has a downstream end connected to the building sewer pipe 22 which is disposed below the floor F on which the toilet main unit 2 is placed.

The flow dividing section 26 is provided on a downstream side of the upstream discharge conduit section 24. The flow dividing section 26 is connected to the upstream discharge conduit section 24 and to the downstream discharge conduit section 30. The flow dividing section 26 is a linear flow passage extending vertically between the upstream discharge conduit section 24 and the downstream discharge conduit section 30. In FIG. 5, the flow dividing section 26 is indicated by the dotted line. The flow dividing section 26 has a guide portion 32 configured to guide therealong at least part of relatively low-speed flush water (low-speed leading flush water) supplied from the discharge trap pipe 8 so as to flow into the delaying flow passage 28. The flow dividing section 26 has a downward flow passage (downward flow passage region) 34 extending from an upper end to a lower end of the flow dividing section 26 in an upward-downward direction, inside the guide portion 32. In FIG. 5, the downward flow passage 34 is indicated by the one-dot chain line.

The guide portion 32 of the flow dividing section 26 is formed on the side of the rise path 8*b* of the discharge trap pipe 8 from a peripheral wall 34*a* defining the downward flow passage 34 of the flow dividing section 26, and between the downward flow passage 34 of the flow dividing section 26 and the delaying flow passage 28. In other words, the guide portion 32 is disposed forward of the downward flow passage 34. The guide portion 32 is formed to hang down such that it extends obliquely downwardly from an upper end thereof and has a lower end expanding toward an inside of the delaying flow passage 28. The guide portion 32 forms an acute angle $\alpha 1$ with respect to a vertical line Z. The angle $\alpha 1$ may be set in the range of 5 to 60 degrees, preferably in the range of 5 to 45 degrees, more preferably to 30 degrees. Between the lower end of the guide portion 32 and a bottom wall surface 50 of the delaying flow passage 28, an inflow opening is formed.

As depicted in FIG. 4, the guide portion 32 is formed on the peripheral wall 34*a* defining the downward flow passage 34, on the side of the rise path 8*b* of the discharge trap pipe 8, and forms a cutout-like portion (cutout portion) 36 on the peripheral wall 34*a* on a side opposite to the rise path 8*b*. The cutout-like portion 36 provides a cutoff space in the downward flow passage 34 between one side end and the other side end of the guide portion 32. The guide portion 32 is formed along approximately one-half of the entire circumference of the peripheral wall 34*a* of the downward flow passage 34. In FIG. 4, the cutout space around the cutout-like portion 36 is generally indicated by the two-dot chain line. The guide portion 32 is not formed in the cutout space along the cutout-like portion 36, so that a flow of relatively high-speed flush water for conveying waste (high-speed waste conveyance flow) is suppressed from colliding with the guide portion 32, and thus flows down through the cutout space along the cutout-like portion 36 while maintaining relatively strong momentum.

As depicted in FIGS. 3 and 5, a connection portion 38 between the peripheral wall 34*a* and the guide portion 32 of the flow dividing section 26 is formed to have a smoothly curved surface. The peripheral wall 34*a* of the flow dividing section 26 is formed to have an introduction surface 34*b* which extends approximately vertically to the upper end of the guide portion 32. An inner peripheral surface 8*e* of the outlet 8*d* of the discharge trap pipe 8 is formed so as to be approximately flush with the introduction surface 34*b* of the flow dividing section 26 of the discharge socket 16 (see FIG. 1A).

As depicted in FIG. 6, the delaying flow passage 28 forms a flow passage branched from the flow dividing section 26. The delaying flow passage 28 forms a flow passage in the lateral region E. The delaying flow passage 28 is configured such that flush water flowing on a leading side of the waste and having flowed thereinto from the flow dividing section 26 is enabled to merge with a flush water flow reaching the flow dividing section 26 at a timing after the inflow of the flush water to the delaying flow passage 28. The delaying flow passage 28 is disposed to extend from the guide portion 32 in a transverse direction. The delaying flow passage 28 is formed bilaterally symmetrically with respect to a longitudinal axis of the toilet main unit 2.

The delaying flow passage 28 comprises a connection zone 46 connecting with the flow dividing section 26, and an extended flow passage 48 extending from the connection zone 46 toward the lateral region E.

The connection zone 46 is connected to a specific part of the flow dividing section 26 on the side of the rise path 8*b*. The connection zone 46 has an entrance 40 for accepting flush water guided along the guide portion 32. This entrance 40 also functions as an exit 44 for enabling flush water having flowed into the connection zone 46 to flow out therefrom. The connection zone 46 further functions as a reservoir chamber for enabling flush water having flowed thereinto from the entrance 40 to flow thereinside so as to temporarily stay therein until it flows out from the exit 44. The entrance 40 of the connection zone 46 is located below and outside the guide portion 32. The entrance 40 is formed as an opening including about one-half of the entire circumstance of the flow dividing section 26 on the side of the rise path 8*b*. That is, the delaying flow passage 28 is a reservoir-type delaying flow passage in which a single opening is used as both of the entrance 40 and the exit 44, and flush water temporarily stays therein while flowing thereinside. Further, the connection zone 46 forms a bent flow passage for changing a flow direction of flush water having flowed thereinto from the flow dividing section 26, toward the lateral region E on a lateral side thereof. The connection zone 46 forming the bent flow passage makes it possible to reduce the flow speed of flush water flowing thereinside. Thus, by enabling flush water to flow inside the connection zone 46, it becomes possible to delay a timing at which this flush water flows through the discharge socket 16, with respect to an initial state. Based on this mechanism, the delaying flow passage 28 makes it possible for flush water having flowed thereinto along the guide portion 32 of the flow dividing section 26 to merge with a flush water flow reaching the flow dividing section 26 at a timing after the inflow of the flush water to the delaying flow passage 28, in a delayed manner.

The extended flow passage 48 is provided in each of the first and second side regions of the lateral region E on both sides of the central region D. Alternatively, the extended flow passage 48 may be provided in only one of the first and second side regions of the lateral region E on both sides of the central region D. Further, although the extended flow passage 48 in the first embodiment is provided only in the lateral region E, the extended flow passage 48 may be provided in each of the central region D and the lateral region E. The extended flow passage 48 extends in the direction connecting the inlet 8*f* and the outlet 8*d* of the discharge trap pipe 8, i.e., the forward-rearward (longitudinal) direction of the toilet main unit 2. In side view, the extended flow passage 48 extends from a position beneath the fall path 8*c* of the discharge trap pipe 8 to a position where it partially overlaps the discharge trap pipe 8. The extended flow passage 48 extends the delaying flow passage 28 to an inside of the lateral region E. The extended flow passage 48 expands the delaying flow passage 28 to a wider region in the lateral region E to increase a bottom surface area of the delaying flow passage 28. In this embodiment, the bottom surface area of the delaying flow passage 28 is increased by the extended flow passage 48, as mentioned above. Thus, even in a situation where the flow speed of inflowing flush water is fairly low, it is possible to make it easier to enable the flush water to flow into a wider region of the delaying flow passage 28, and thus make it easier to enable the flush water to flow into the delaying flow passage 28 in a larger volume, as compared to case where the delaying flow passage 28 has a smaller bottom surface area. Thus, by forming the delaying flow passage 28 in the lateral region E to increase the bottom surface area of the delaying flow passage 28 in the lateral region E, it becomes possible to more reliably increase the volume of flush water flowing through the delaying flow passage, irrespective of the flow speed of inflowing flush water. The extended flow passage 48 additionally functions as a reservoir chamber for allowing flush water to temporarily stay therein. The extended flow passage 48 is configured to cause flush water having flowed thereinto from the connection zone 46 to flow therethrough while turning back toward the connection zone 46, thereby reducing the flow speed of flush water having flowed thereinto.

Further, as depicted in FIGS. 5 and 6, the delaying flow passage 28 is formed such that the bottom wall surface 50 thereof protrudes inside the flow dividing section 26 to reach a position below and opposed to the guide portion 32 of the flow dividing section 26. In top view, an edge 50*a* of the bottom wall surface 50 of the delaying flow passage 28 is located outward of an outer edge of the downward flow passage 35. The delaying flow passage 28 is formed such that the bottom wall surface 50 in the connection zone 46 and the extended flow passage 48 slightly inclines downwardly toward the entrance 40. This makes it possible to reduce the flow speed of inflowing flush water, and discharge water remaining in the delaying flow passage 28, toward the entrance 40.

Figure 1B:
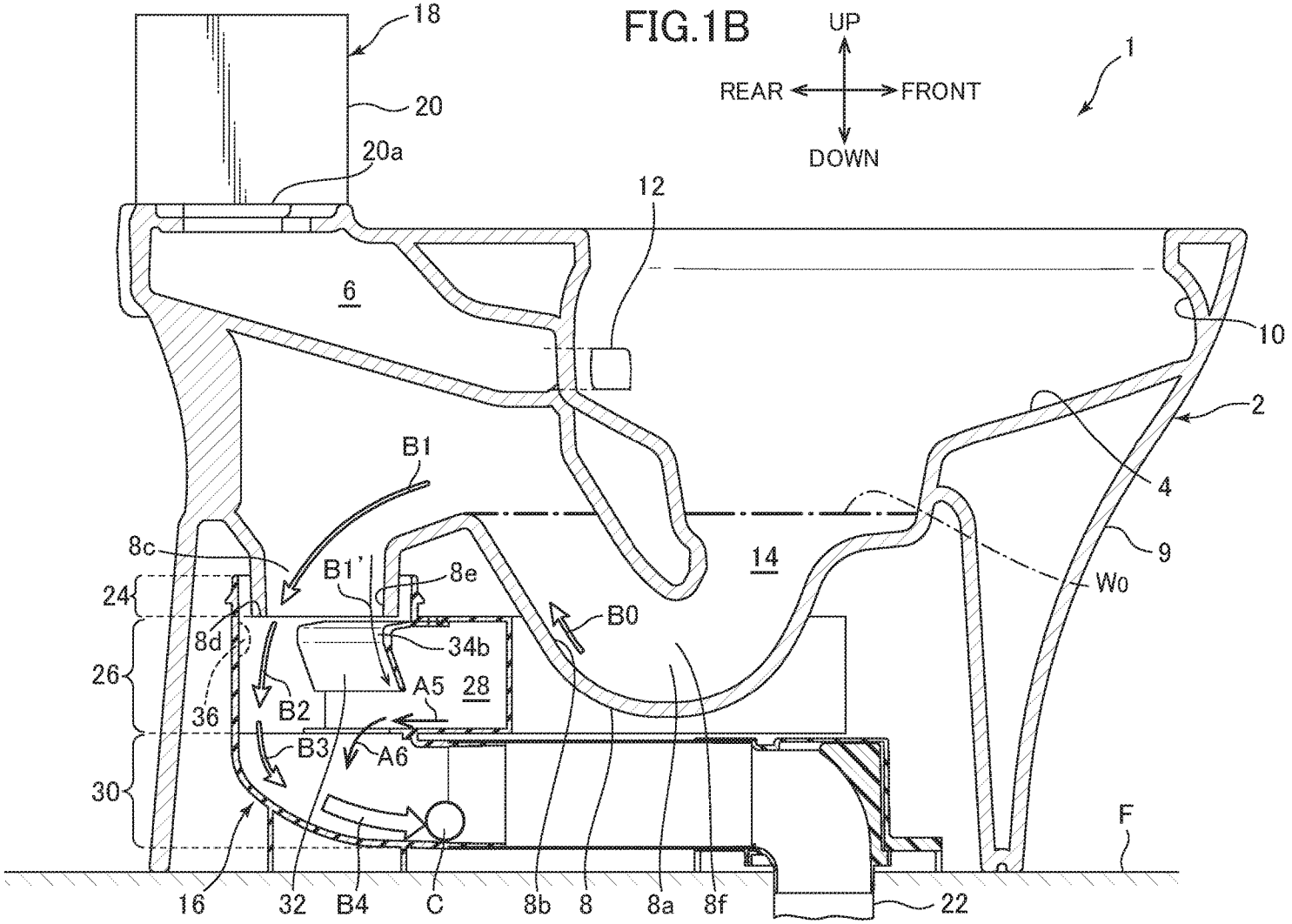
FIG. 1B is a vertical sectional view depicting the flush toilet according to the first embodiment, wherein a state of waste conveyance flow flowing on a trailing side of waste to wash down or convey the waste, is indicated.

With reference to FIGS. 1A, 1B and 6, an operation (function) of the flush toilet according to the first embodiment will be described below.

Specifically, a state when draining is performed along with toilet flushing in the flush toilet according to the first embodiment will be described with reference to FIGS. 1A, 1B and 6. In FIGS. 1A, 1B and 6, a flow of leading flush water, i.e., relatively low-speed flush water flowing on a leading side of waste C, is indicated by the arrowed lines A (A0 to A6), and a waste conveyance flow, i.e., flush water mainly flowing on a trailing side of the waste C to wash down or convey the waste C, is indicated by the arrowed lines B (B0 to B4). As used herein, the term "leading side of the waste C" means a forward side preceding the waste C on a flow passage along which the waste C is flowing. Further, the term "trailing side of the waste C" means a rearward side following the waste C on the flow passage along which the waste C is flowing.

As depicted in FIGS. 1A, 1B and 6, after a user uses the flush toilet 1, the discharge port 20*a* of the flush water tank 20 of the flush water tank unit 18 is opened, and thus flush water is discharged from the discharge port 20*a* to the water conducting passage 6 of the toilet main unit 2. Then, the flush water in the water conducting passage 6 is spouted from the rim spout port 12 of the flush toilet 1 to perform flushing of the toilet main unit 2. According to a water flow action caused by drop of flush water from the water conducting passage 6 to the water pooling region 14, flush water containing the waste C in the water pooling region 14 is pushed from the inlet path 8*a* to the rise path 8*b* and the fall path 8*c* of the discharge trap pipe 8 and then sent to the outlet 8*d* the discharge trap pipe 8.

Firstly, a state in which relatively low-speed flush water is flowing on the leading side of the waste C will be described.

As depicted in FIG. 1A, at a start of toilet flushing, relatively low-speed flush water A flows on the leading side of the waste C, as indicated by the arrowed line A0. The leading flush water A flowing on the leading side of the waste C also has a relatively small volume.

As depicted in FIG. 1A, at the start of toilet flushing, the leading flush water A gradually flows out from the rise path 8*b* to the side of the fall path 8*c*. The relatively low-speed leading flush water A has weak momentum, and thus flows down along part of the inner peripheral surface 8*e* of the fall path 8*c* on the side of the rise path 8*b*, as indicated by the arrowed line A1. Further, the leading flush water A flows down from the inner peripheral surface 8*e* into the discharge socket 16 smoothly along the introduction surface 34*b* of the flow dividing section 26, and is then guided along the guide portion 32 so as to flow from the introduction surface 34*b* toward the delaying flow passage 28, as indicated by the arrowed line A2. The leading flush water A is drawn to the guide portion 32 by the Coanda effect, so that a flow direction thereof is changed to a direction along which the guide portion 32 extends. In this way, at least part of the leading flush water A flows into the entrance 40 of the connection zone 46 of the delaying flow passage 28, as indicated by the arrowed line A3. The leading flush water A having flowed into the connection zone 46 flows from the connection zone 46 toward the extended flow passage 48, as indicated by the arrowed lines A4 in FIG. 9. The flow direction of the leading flush water A is changed within the connection zone 46, so that the flow speed of the leading flush water A is reduced as compared to that at a timing of the inflow to the delaying flow passage 28. As a result of flowing through the connection zone 46 and the extended flow passage 48, the leading flush water A is delayed with respect to a flow of flush water flowing through the downward flow passage 34 as a main flow passage. The leading flush water A gently flows in such a manner as to be temporarily held in the connection zone 46 and the extended flow passage 48, and then returns to the main stream. When the volume of flush water flowing into the entrance 40 of the connection zone 46 becomes small or zero after elapse of a given time from the start of toilet flushing, the leading flush water A in the connection zone 46 and the extended flow passage 48 flows toward the exit 44 and then flows out toward the downward flow passage 34 through the exit 44, as indicated by the arrowed line A5 in FIG. 1B.

As used herein, the term "Coanda effect" means a phenomenon that a jet flow is bent along a solid wall. For example, there is a phenomenon that, when a finger is moved close to water from a faucet, a flow of the water is bent toward the finger. This phenomenon is also caused by the Coanda effect.

Secondly, a waste conveyance flow for washing down waste will be described.

As depicted in FIG. 1A, at a start of toilet flushing, according to a water flow action caused by drop of flush water from the water conducting passage 6 to the water pooling region 14, a waste conveyance flow B for strongly washing down waste is formed.

The waste conveyance flow B acting to wash down the waste C flows around the waste C and mainly on the trailing side of the waste C, as indicated by the arrowed line B0. The waste conveyance flow B is formed mainly of trailing flush water flowing on the trailing side of the waste C. The waste conveyance flow B has a relatively high flow speed and a relatively large flow volume. The waste conveyance flow B acts to push the waste C mainly from the trailing side thereof so as to wash down the waste C. The inventor of the present invention found that a force of the waste conveyance flow B acting to wash down the waste C and kinetic energy of the waste conveyance flow B can be further improved by increasing the volume of the waste conveyance flow B.

As depicted in FIG. 1B, because the waste C and the waste conveyance flow B have a relatively high flow speed, a main stream of the waste conveyance flow B with the waste C flows down along part of a peripheral wall of the fall path 8*c* on the side opposite to the rise path 8*b*, as indicated by the arrowed line B1. Then, the main stream of the waste conveyance flow B with the waste C passes by the cutout-like portion 36 of the peripheral wall 34*a* of the downward flow passage 34, on the side opposite to the rise path 8*b*, as indicated by the arrowed line B2. The main stream of the waste conveyance flow B with the waste C further flows down through the downward flow passage 34 as the main flow passage as indicated by the arrowed line B3, so that it is suppressed from colliding with the bottom wall surface of the delaying flow passage 28 and flowing into the delaying flow passage 28.

As regards the leading flush water A having a relatively low flow speed, a relatively large proportion by volume of leading flush water A flowing from the discharge trap pipe 8 is guided to the delaying flow passage 28 along the guide portion 32. On the other hand, as regards the waste conveyance flow B having a relatively high flow speed, a relatively small proportion by volume of a waste conveyance flow B flowing from the discharge trap pipe 8 is guided to the delaying flow passage 28 along the guide portion 32, as indicated by the arrowed line B1. Thus, a rate of part of the leading flush water A to be guided to the delaying flow passage 28 along the guide portion 32 is greater than a rate of part of the waste conveyance flow B to be guided to the delaying flow passage 28 along the guide portion 32. In this case, the rate of the part of the waste conveyance flow B to be guided to the delaying flow passage 28 along the guide portion 32 is 0% or more.

The leading flush water A flowing out to the downward flow passage 34 through the exit 44 merges with the waste conveyance flow B, as indicated by the arrowed line A6. As mentioned above, the leading flush water A having flowed into the delaying flow passage 28 flows inside the delaying flow passage 28 until it flows out toward the downward flow passage 34 through the exit 44. In this process, a given time has elapsed. Thus, the leading flush water A merges with a waste conveyance flow B reaching the downward flow passage 34 of the flow dividing section 26 at a timing after a given time has elapsed since the inflow of the leading flush water A to the delaying flow passage 28. That is, part of the leading flush water A having flowed into the delaying flow passage 28 is converted to the waste conveyance flow B.

This makes it possible to add the leading flush water A contributing less to conveyance of the waste C, to the waste conveyance flow B, and thus increase the volume of the waste conveyance flow B as indicated by the arrowed line B4, thereby improving a capability of conveying the waste C (waste conveyance capability). The arrowed line B4 indicates the improved waste conveyance flow B which is increased in terms of flow rate and/or volume based on merging of the leading flush water A and the waste conveyance flow B.

The improved waste conveyance flow B with the waste C flows toward the downstream side through the downstream discharge conduit section 30, and is finally discharged into the building sewer pipe 22.

Next, with reference to FIGS. 7 to 9, a first modification of the flush toilet according to the first embodiment will be described, wherein the delaying flow passage 28 of the discharge socket 16 in the flush toilet according to the first embodiment is modified.

In the first modification, the same element or component as that in the above first embodiment is assigned with the same reference numeral or sign, and its description will be omitted. In the first embodiment, the delaying flow passage 28 of the discharge socket 16 is a reservoir-type delaying flow passage in which a single opening is used as both of the entrance 40 and the exit 44, and flush water temporarily stays therein.

However, the first embodiment may be modified to employ a bypass-type delaying flow passage 128 in which the entrance 40 and the exit 44 are separately arranged to form a bypass flow passage for flush water, instead of the above reservoir-type delaying flow passage 28.

A discharge socket 16 in the first modification comprises an upstream discharge conduit section 24, a flow dividing section 26, a delaying flow passage 128, and a downstream discharge conduit section 130, which are arranged approximately in this order in a direction from an upstream end to a downstream end thereof.

The downstream discharge conduit section 130 is provided on a downstream side of the flow dividing section 26. The downstream discharge conduit section 130 forms a transverse flow passage which extends linearly in a transverse direction to reach a position of a building sewer pipe 22. The downstream discharge conduit section 130 has a downstream end connected to the building sewer pipe 22 which is disposed below the floor F on which a toilet main unit 2 is placed. The downstream discharge conduit section 130 has an opening formed in an upper wall of a downstream portion thereof and configured to accept flush water which flows down from an aftermentioned exit 144.

Figure 7:
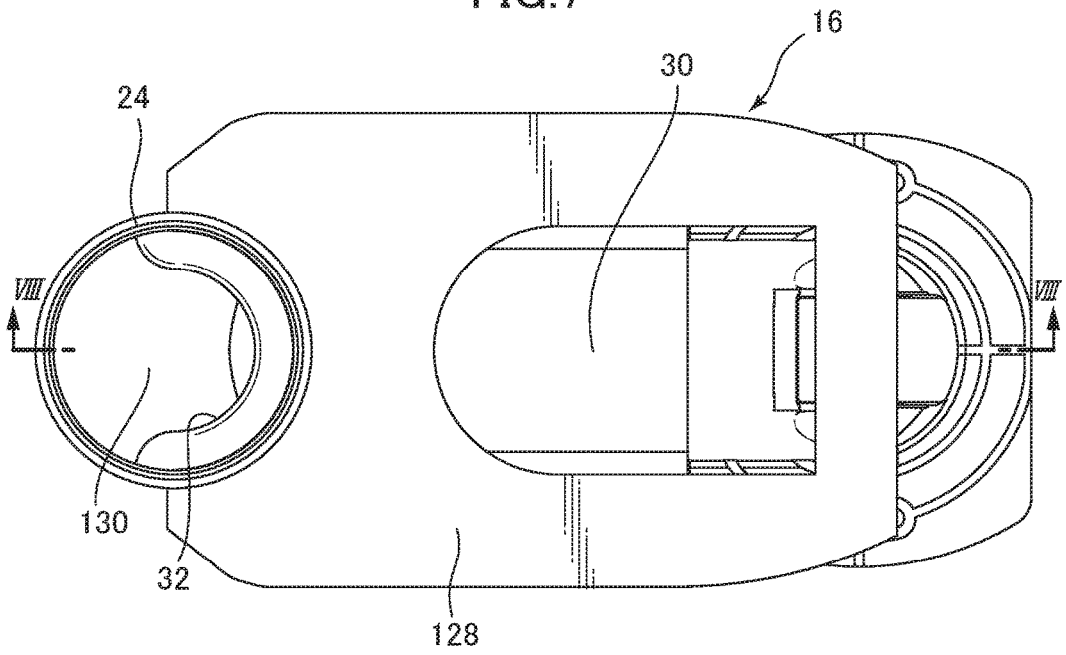
FIG. 7 is a top view depicting a discharge socket in a first modification of the flush toilet according to the first embodiment, wherein a delaying flow passage of the discharge socket in the flush toilet according to the first embodiment is modified.
Figure 8:
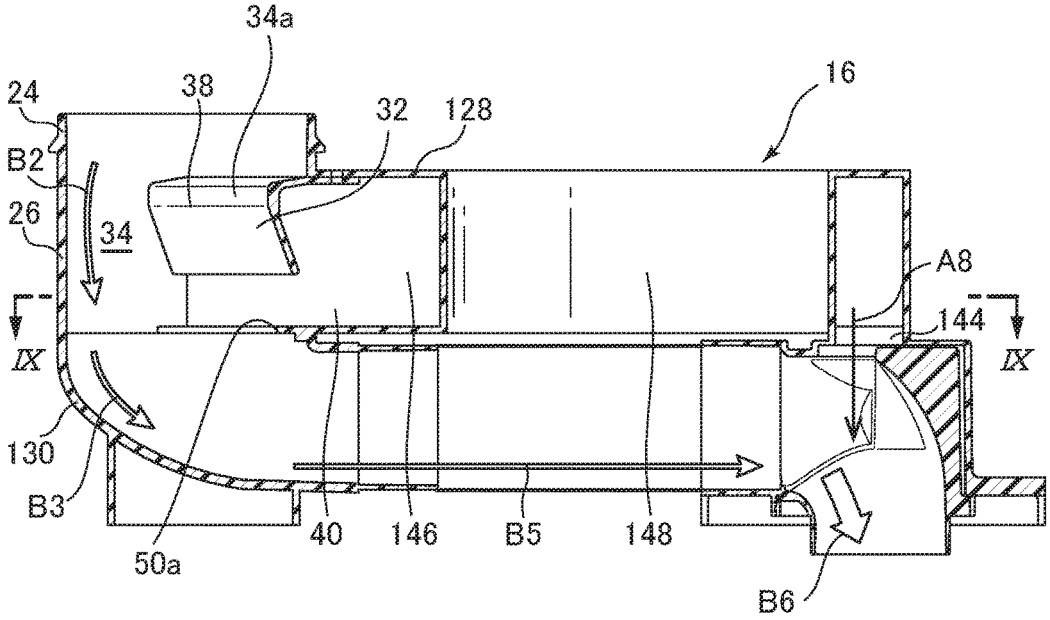
FIG. 8 is a sectional view taken along the line VIII-VIII in FIG. 7.
Figure 9:
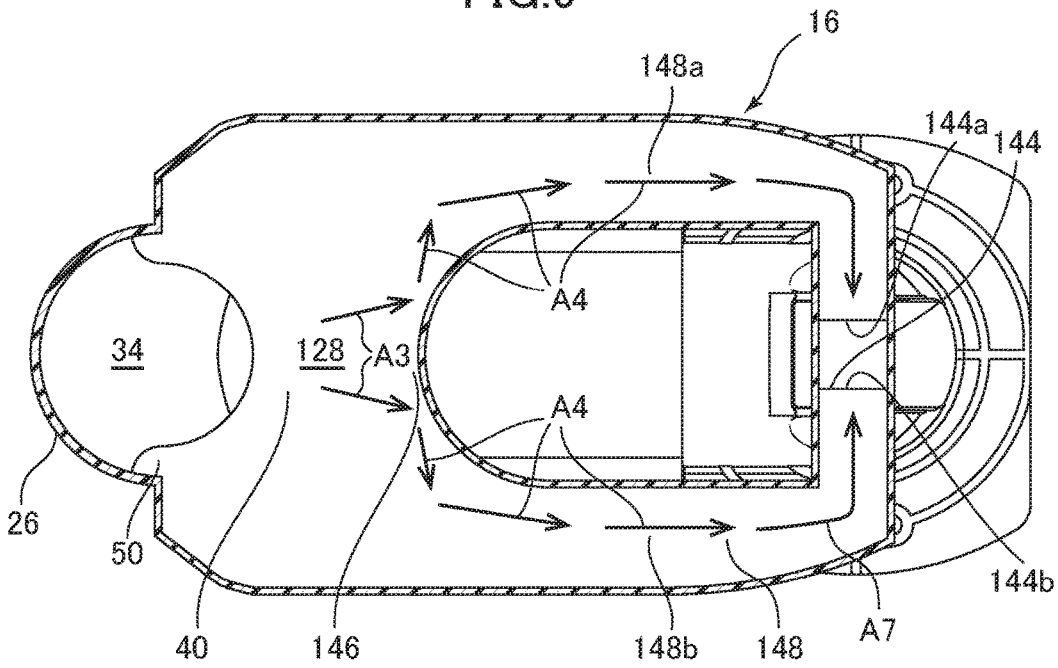
FIG. 9 is a sectional view depicting the discharge socket in the first modification of the flush toilet according to the first embodiment, taken along the line IX-IX in FIG. 8.

As depicted in FIGS. 7 to 9, the delaying flow passage 128 forms a flow passage branched from the flow dividing section 26. The delaying flow passage 128 forms the flow passage in a lateral region E. The delaying flow passage 128 is configured such that leading flush water having flowed thereinto from the flow dividing section 26 is enabled to merge with a flush water flow reaching the flow dividing section 26 at a timing after the inflow of the leading flush water to the delaying flow passage 128. The delaying flow passage 128 is disposed to extend from a guide portion 32 in a forward transverse direction. The delaying flow passage 128 is formed bilaterally symmetrically with respect to a longitudinal axis of the toilet main unit 2.

The delaying flow passage 128 comprises a connection zone 146 connecting with the flow dividing section 26, and an extended flow passage 148 extending from the connection zone 146 toward the lateral region E.

The connection zone 146 is connected to a specific part of the flow dividing section 26 on the side of a rise path 8*b* of a discharge trap pipe 8. The connection zone 146 has an entrance 40 for accepting flush water guided along the guide portion 32. The connection zone 146 further functions as a reservoir chamber for enabling flush water having flowed thereinto from the entrance 40 to flow thereinside so as to temporarily stay therein until it flows out from the aftermentioned exit 144. The delaying flow passage 128 further comprises an exit 144 provided separately from the entrance 40 of the connection zone 146 and configured to allow flush water having flowed into the delaying flow passage 128 to flow out therefrom. The exit 144 forms an exit of the extended flow passage 148. Thus, the connection zone 146 and the extended flow passage 148 of the delaying flow passage 128 form a bypass flow passage extending from the entrance 40 to the exit 144.

The connection zone 146 forms a bent flow passage for changing a flow direction of flush water having flowed thereinto from the flow dividing section 26, toward the lateral region E on a lateral side thereof. The connection zone 146 forming the bent flow passage makes it possible to reduce the flow speed of flush water flowing thereinside. Thus, by enabling flush water to flow inside the connection zone 146, it becomes possible to delay a timing at which this flush water flows through the discharge socket 16, with respect to an initial state.

The extended flow passage 148 comprises a first extended flow passage 148*a* provided in one of the first and second side regions of the lateral region E on both sides of a central region D, and a second extended flow passage 148*b* provided in the other side region of the lateral region E. As above, the extended flow passage 148 is provided in each of the first and second side regions of the lateral region E on both sides of the central region D. Alternatively, the extended flow passage 148 may be provided in only one of the first and second side regions of the lateral region E on both sides of the central region D. Further, although the extended flow passage 148 in the first modification is provided only in the lateral region E, the extended flow passage 148 may be provided in each of the central region D and the lateral region E. The extended flow passage 148 extends in a direction along the discharge trap pipe 8, i.e., a forward-rearward (longitudinal) direction of the toilet main unit 2. In side view, the extended flow passage 148 extends from a position beneath a fall path 8*c* of the discharge trap pipe 8 to a position where it partially overlaps the discharge trap pipe 8. The extended flow passage 148 extends the delaying flow passage 128 in the lateral region E. The extended flow passage 148 expands the delaying flow passage 128 to a wider region in the lateral region E to increase a bottom surface area of the delaying flow passage 128. In the first modification, the bottom surface area of the delaying flow passage 128 is increased by the extended flow passage 148, as mentioned above. Thus, even in a situation where the flow speed of inflowing flush water is fairly low, it is possible to make it easier to enable the flush water to flow into a wider region of the delaying flow passage 128, and thus make it easier to enable the flush water to flow into the delaying flow passage 128 in a larger volume, as compared to case where the delaying flow passage 128 has a smaller bottom surface area. Thus, by forming the delaying flow passage 128 in the lateral region E to increase the bottom surface area of the delaying flow passage 128 in the lateral region E, it becomes possible to more reliably increase the volume of flush water flowing through the delaying flow passage, irrespective of the flow speed of inflowing flush water. The extended flow passage 148 additionally functions as a reservoir chamber for allowing flush water to temporarily stay therein. The extended flow passage 148 is configured to reduce the flow speed of flush water having flowed thereinto from the connection zone 146, during a course in which the flush water having flowed thereinto flows therethrough transversely with respect to a vertical direction.

The delaying flow passage 128 is formed such that a bottom wall surface 50 thereof in the connection zone 146 and the extended flow passage 148 slightly inclines downwardly toward the exit 144, respectively. This makes it possible to adequately reduce the flow speed of inflowing flush water, and discharge water remaining in the delaying flow passage 128, toward the exit 144.

The exit 144 is formed separately from the entrance 40, at a position different from that of the entrance 40. Specifically, the exit 144 is formed at a downstream end of the extended flow passage 148. The exit 144 comprises a first exit 144*a* forming an exit of the first extended flow passage 148*a*, and a second exit 144*b* forming an exit of the second extended flow passage 148*b*. The exit 144 is formed at a position above the downstream discharge conduit section 130 and above the building sewer pipe 22. The exit 144 is opened downwardly to enable flush water to flow down into the downstream discharge conduit section 130 and above the building sewer pipe 22. Thus, the delaying flow passage 128 is a bypass-type delaying flow passage in which the entrance 40 and the exit 144 are separately arranged to form a bypass flow passage for flush water. Based on the above structure, the delaying flow passage 128 makes it possible to enable flush water having flowed therein along the guide portion 32 of the flow dividing section 26 to merge with a flush water flow reaching the flow dividing section 26 at a timing after the inflow of the flush water to the delaying flow passage 128, at a given position of the downstream discharge conduit section 130. The first extended flow passage 148*a* extending from the connection zone 146 to the first exit 144*a* and the second extended flow passage 148*b* extending from the connection zone 146 to the second exit 144*b* are formed independently of each other.

With reference to FIGS. 1A, 1B and 7 to 9, an operation (function) pertaining to the delaying flow passage in the first modification of the flush toilet according to the first embodiment will be described below.

Specifically, a state when draining is performed along with toilet flushing in the first modification of the flush toilet according to the first embodiment will be described with reference to FIGS. 1A, 1B, 8 and 9. In FIGS. 1A, 1B, 8 and 9, a flow of leading flush water, i.e., relatively low-speed flush water flowing on a leading side of waste C, is indicated by the arrowed lines A (A0 to A4, A7 and A8), and a waste conveyance flow, i.e., relatively high-speed flush water mainly flowing on a trailing side of the waste C to wash down or convey the waste C, is indicated by the arrowed lines B (B0 to B3, B5 and B6). In the following description about the operation in the first modification, the same element or component as that in the above first embodiment is also assigned with the same reference numeral or sign, and its description will be omitted.

Firstly, a state in which relatively low-speed flush water is flowing on the leading side of the waste C will be described.

As depicted in FIG. 1A, at a start of toilet flushing, relatively low-speed flush water A flows on the leading side of the waste C, as indicated by the arrowed line A0.

As depicted in FIG. 1A, at the start of toilet flushing, the leading flush water A gradually flows out from the rise path 8*b* to the side of the fall path 8*c*. The relatively low-speed leading flush water A has weak momentum, and thus flows down along part of an inner peripheral surface 8*e* of the fall path 8*c* on the side of the rise path 8*b*, as indicated by the arrowed line A1. Further, the leading flush water A flows down from the inner peripheral surface 8*e* into the discharge socket 16 smoothly along an introduction surface 34*b* of the flow dividing section 26, and is then guided along the guide portion 32 so as to flow from the introduction surface 34*b* toward the delaying flow passage 128, as indicated by the arrowed line A2. The leading flush water A is drawn to the guide portion 32 by the Coanda effect, so that a flow direction thereof is changed to a direction along which the guide portion 32 extends. As depicted in FIG. 9, at least part of the leading flush water A flows into the entrance 40 of the delaying flow passage 128, as indicated by the arrowed lines A3. The leading flush water A having flowed into the connection zone 146 flows from the connection zone 146 toward the extended flow passage 148, as indicated by the arrowed lines A4. The flow direction of the leading flush water A is changed within the connection zone 146, so that the flow speed of the leading flush water A is reduced as compared to that at a timing of the inflow to the delaying flow passage 128.

The connection zone 146 and the extended flow passage 148 form a bypass flow passage. Thus, the leading flush water A flows through the extended flow passage 148 and turns toward the exit 144 of the extended flow passage 148, as depicted in the arrowed lines A7. As a result of flowing through the connection zone 146 and the extended flow passage 148, the leading flush water A is delayed with respect to a flow of flush water flowing through a downward flow passage 34 as a main flow passage. Then, the leading flush water A flows down from the exit 144, as indicated by the arrowed line A8 in FIG. 8, and flows down through the downstream discharge conduit section 130 and the building sewer pipe 22.

Secondly, a waste conveyance flow for washing down waste will be described.

As indicated by the arrowed line B0 in FIGS. 1A and 1B, a waste conveyance flow B acting to wash down the waste C flows around the waste C and mainly on the trailing side of the waste C. A main stream of the waste conveyance flow B with the waste C flows down along part of a peripheral wall of the fall path 8*c* on the side opposite to the rise path 8*b*, as indicated by the arrowed line B1. Then, the main stream of the waste conveyance flow B with the waste C passes by a cutout-like portion 36 of a peripheral wall 34*a* of the downward flow passage 34, as indicated by the arrowed line B2. The main stream of the waste conveyance flow B with the waste C further flows down through the downward flow passage 34, so that colliding with the bottom wall surface 50 of the delaying flow passage 128 and flowing into the delaying flow passage 128 can be suppressed.

As depicted in FIG. 8, the main stream of the waste conveyance flow B with the waste C flows through the downstream discharge conduit section 130, as indicated by the arrowed line B5. The leading flush water A flowing out through the exit 144 merges with the main stream of the waste conveyance flow B with the waste C, at a position of a downstream portion of the downstream discharge conduit section 130, as indicated by the arrowed line A8. As mentioned above, the leading flush water A having flowed into the delaying flow passage 128 passes through the bypass flow passage comprising the connection zone 146 and the extended flow passage 148 and having a given distance, until it flows out toward the downstream discharge conduit section 130 through the exit 144. In this process, a given time has elapsed. Further, the leading flush water A passing through the bypass flow passage has a relatively low flow speed, and the waste conveyance flow B as a trailing flow has a relatively high flow speed. Thus, the leading flush water A having flowed into the delaying flow passage 128 merges with a waste conveyance flow B reaching the downward flow passage 34 of the flow dividing section 26 at a delayed timing after an elapse of a given time since the inflow of the leading flush water A to the delaying flow passage 128, at a position of the downstream portion of the downstream discharge conduit section 130. That is, part of the leading flush water A having flowed into the delaying flow passage 128 is converted to the waste conveyance flow B. This makes it possible to add the leading flush water A contributing less to conveyance of the waste C, to the waste conveyance flow B, and thus increase the volume of the waste conveyance flow B as indicated by the arrowed line B6, thereby improving a capability of conveying the waste C (waste conveyance capability). The arrowed line B6 indicates the improved waste conveyance flow B which is increased in terms of flow rate and/or volume based on merging of the leading flush water A and the waste conveyance flow B.

The waste C and the improved waste conveyance flow B further flow toward the downstream side through the downstream discharge conduit section 30, and is finally discharged into the building sewer pipe 22.

Next, with reference to FIG. 10, a second modification of the flush toilet according to the first embodiment will be described, wherein the delaying flow passage 28 of the discharge socket 16 in the flush toilet according to the first embodiment is modified. In the second modification, the same element or component as that in the above first embodiment is assigned with the same reference numeral or sign, and its description will be omitted. In the first embodiment, the delaying flow passage 28 of the discharge socket 16 is a reservoir-type delaying flow passage in which a single opening is used as both of the entrance 40 and the exit 44, and flush water temporarily stays therein.

However, the first embodiment may be modified to employ a bypass-type delaying flow passage 228 in which the entrance 40 and the exit 44 are separately arranged to form a bypass flow passage for flush water, instead of the above reservoir-type delaying flow passage 28.

A discharge socket 16 in the second modification comprises an upstream discharge conduit section 24, a flow dividing section 26, a delaying flow passage 228, and a downstream discharge conduit section 30, which are arranged approximately in this order in a direction from an upstream end to a downstream end thereof.

Figure 10:
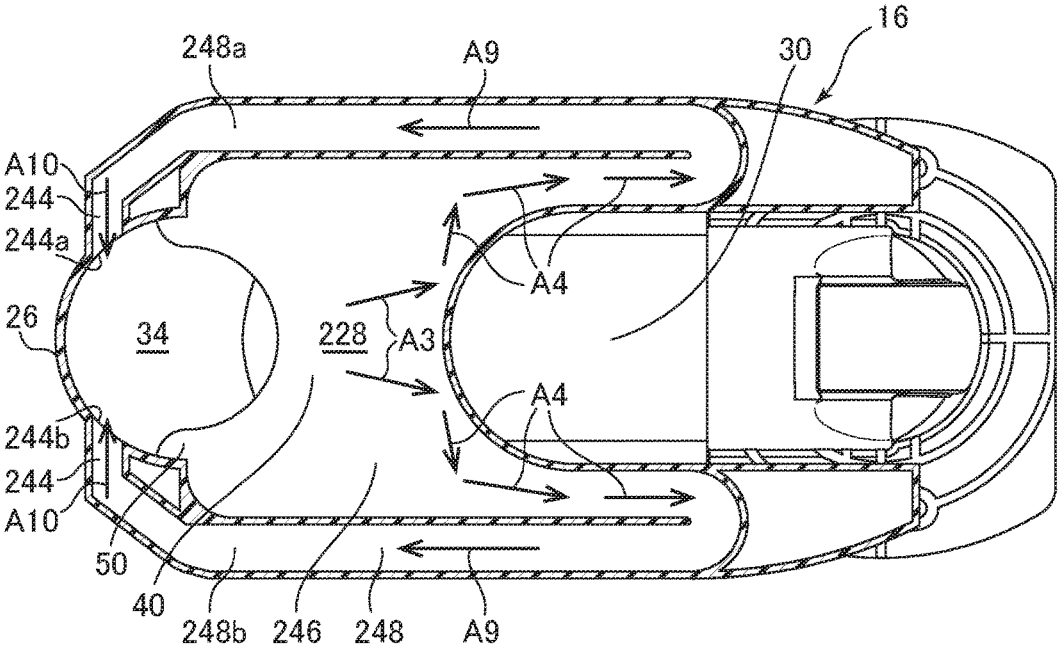
FIG. 10 is a horizontal sectional view depicting an internal structure of a discharge socket in a second modification of the flush toilet according to the first embodiment, wherein the delaying flow passage of the discharge socket in the flush toilet according to the first embodiment is modified.

As depicted in FIG. 10, the delaying flow passage 228 forms a flow passage branched from the flow dividing section 26. The delaying flow passage 228 forms the flow passage in a lateral region E. The delaying flow passage 228 is configured such that leading flush water having flowed thereinto from the flow dividing section 26 is enabled to merge with a flush water flow reaching the flow dividing section 26 at a timing after the inflow of the leading flush water to the delaying flow passage 228. The delaying flow passage 228 is disposed to extend from a guide portion 32 in a forward transverse direction. The delaying flow passage 228 is formed bilaterally symmetrically with respect to a longitudinal axis of a toilet main unit 2.

The delaying flow passage 228 comprises a connection zone 246 connecting with the flow dividing section 26, and an extended flow passage 248 extending from the connection zone 246 toward the lateral region E.

The connection zone 246 is connected to a specific part of the flow dividing section 26 on the side of a rise path 8*b* of a discharge trap pipe 8. The connection zone 246 has an entrance 40 for accepting flush water guided along the guide portion 32. The connection zone 246 further functions as a reservoir chamber for enabling flush water having flowed thereinto from the entrance 40 to flow thereinside so as to temporarily stay therein until it flows out from an aftermentioned exit 244. The delaying flow passage 228 further comprises an exit 244 provided separately from the entrance 40 of the connection zone 246 and configured to allow flush water having flowed into the delaying flow passage 228 to flow out therethrough. The exit 244 forms an exit of the extended flow passage 248. Thus, the connection zone 246 and the extended flow passage 248 of the delaying flow passage 228 form a bypass flow passage extending from the entrance 40 to the exit 244.

The connection zone 246 forms a bent flow passage for changing a flow direction of flush water having flowed thereinto from the flow dividing section 26, toward the lateral region E on a lateral side thereof. The connection zone 246 forming the bent flow passage makes it possible to reduce the flow speed of flush water flowing thereinside. Thus, by enabling flush water to flow inside the connection zone 246, it becomes possible to delay a timing at which this flush water flows through the discharge socket 16, with respect to an initial state.

The extended flow passage 248 comprises a first extended flow passage 248*a* provided in one of the first and second side regions of the lateral region E on both sides of a central region D, and a second extended flow passage 248*b* provided in the other side region of the lateral region E. As above, the extended flow passage 248 is provided only in each of the first and second side regions of the lateral region E on both sides of the central region D. Alternatively, the extended flow passage 248 may be provided in only one of the first and second side regions of the lateral region E on both sides of the central region D. Further, although the extended flow passage 248 in the second modification is provided only in the lateral region E, the extended flow passage 248 may be provided in each of the central region D and the lateral region E. The extended flow passage 248 extends in a direction along the discharge trap pipe 8, i.e., a forward-rearward (longitudinal) direction of the toilet main unit 2. The extended flow passage 248 extends from the connection zone 246 toward a front end of the toilet main unit 2. Then, the extended flow passage 248 U-turns outwardly and extends rearwardly to a lateral side of the flow dividing section 26. In side view, the extended flow passage 248 extends from a position beneath a fall path 8*c* of the discharge trap pipe 8 to a position where it partially overlaps the discharge trap pipe 8. The extended flow passage 248 extends the delaying flow passage 228 in the lateral region E. The extended flow passage 248 expands the delaying flow passage 228 to a wider region in the lateral region E to increase a bottom surface area of the delaying flow passage 228. The bottom surface area of the delaying flow passage 228 is increased by the extended flow passage 248, as mentioned above. Thus, even in a situation where the flow speed of inflowing flush water is fairly low, it is possible to make it easier to enable the flush water to flow into a wider region of the delaying flow passage 228, and thus make it easier to enable the flush water to flow into the delaying flow passage 228 in a larger volume, as compared to case where the delaying flow passage 228 has a smaller bottom surface area. Therefore, by forming the delaying flow passage 228 in the lateral region E to increase the bottom surface area of the delaying flow passage 228 in the lateral region E, it becomes possible to more reliably increase the volume of flush water flowing through the delaying flow passage, irrespective of the flow speed of inflowing flush water. The extended flow passage 248 additionally functions as a reservoir chamber for allowing flush water to temporarily stay therein. The extended flow passage 248 is configured to reduce the flow speed of flush water having flowed thereinto from the connection zone 246, during a course in which the flush water having flowed thereinto flows therethrough transversely over a relatively long distance.

The delaying flow passage 228 is formed such that a bottom wall surface 50 thereof in the connection zone 246 and the extended flow passage 248 slightly inclines downwardly toward the exit 244, respectively. This makes it possible to reduce the flow speed of inflowing flush water, and discharge water remaining in the delaying flow passage 228, toward the exit 244.

The exit 244 is formed separately from the entrance 40, at a position different from that of the entrance 40. Specifically, the exit 244 is formed at a downstream end of the extended flow passage 248. The exit 244 comprises a first exit 244*a* forming an exit of the first extended flow passage 248*a*, and a second exit 244*b* forming an exit of the second extended flow passage 248*b*. The exit 244 is formed such that it is opened in a peripheral wall defining a downward flow passage 34 of the flow dividing section 26. Thus, the exit 244 is opened toward the flow dividing section 26 located upstream of a transverse flow passage of the downstream discharge conduit section 30. That is, the exit 244 is opened to enable flush water having flowed into the delaying flow passage 228 to flow out to an inside of the downward flow passage 34 of the flow dividing section 26. The exit 244 is formed at a position on a lateral side of the downward flow passage 34 and rearward of the entrance 40. Further, in top view, the exit 244 is located between an end of the downward flow passage 34 on a side opposite to the rise path 8*b* and both ends of the guide portion 32 on the side opposite to the rise path 8*b*. In this way, the outlet 244 is disposed on an outer periphery of the downward flow passage 34 in side-by-side relation to and independently of the inlet 40. Thus, the delaying flow passage 228 is a bypass-type delaying flow passage in which the entrance 40 and the exit 244 are separately arranged to form a bypass flow passage for flush water in a reservoir chamber. Based on the above structure, the delaying flow passage 228 makes it possible to enable flush water having flowed therein along the guide portion 32 of the flow dividing section 26 to merge with a flush water flow reaching the flow dividing section 26 at a timing after the inflow of the flush water to the delaying flow passage 228. The first extended flow passage 248*a* extending from the connection zone 246 to the first exit 244*a* and the second extended flow passage 248*b* extending from the connection zone 246 to the second exit 244*b* are formed independently of each other.

With reference to FIGS. 1A, 1B and 10, an operation (function) pertaining to the delaying flow passage in the second modification of the flush toilet according to the first embodiment will be described below.

Specifically, a state when draining is performed along with toilet flushing in the second modification of the flush toilet according to the first embodiment will be described with reference to FIGS. 1A, 1B and 10. In FIGS. 1A, 1B and 10, a flow of leading flush water, i.e., relatively low-speed flush water flowing on a leading side of waste C, is indicated by the arrowed lines A (A0 to A4, A9 and A10), and a waste conveyance flow, i.e., relatively high-speed flush water mainly flowing on a trailing side of the waste C to wash down or convey the waste C, is indicated by the arrowed lines B (B0 to B4). In the following description about the operation in the second modification, the same element or component as that in the above first embodiment is also assigned with the same reference numeral or sign, and its description will be omitted.

Firstly, a state in which relatively low-speed flush water is flowing on the leading side of the waste C will be described.

As depicted in FIG. 1A, the relatively low-speed leading flush water A has weak momentum, and thus flows down along part of an inner peripheral surface 8*e* of the fall path 8*c* on the side of the rise path 8*b*, as indicated by the arrowed line A1. Further, the leading flush water A flows down from the inner peripheral surface 8*e* into the discharge socket 16 smoothly along an introduction surface 34*b* of the flow dividing section 26, and is then guided along the guide portion 32 so as to flow from the introduction surface 34*b* toward the delaying flow passage 228, as indicated by the arrowed line A2. As depicted in FIG. 10, at least part of the leading flush water A flows into the entrance 40 of the delaying flow passage 228, as indicated by the arrowed lines A3. In this process, the leading flush water A flows down through part of the downward flow passage 34 on the side of the rise path 8*b*, so that flowing into the exit 244 can be suppressed. The leading flush water A having flowed into the connection zone 246 flows from the connection zone 246 toward the extended flow passage 248, as indicated by the arrowed lines A4. The flow direction of the leading flush water A is changed within the connection zone 246, so that the flow speed of the leading flush water A is reduced as compared to that at a timing of the inflow to the delaying flow passage 228.

The connection zone 246 and the extended flow passage 248 form a bypass flow passage. Thus, after the leading flush water A flows forwardly through the extended flow passage 248, the leading flush water A turns around rearwardly and flows toward the exit 244 of the extended flow passage 248, as depicted in the arrowed lines A9. The extended flow passage 248 forms a flow passage returning to the downward flow passage 34. Then, the leading flush water A flows toward the exit 244, and flows out toward the downward flow passage 34 through the exit 244, as indicated by the arrowed line A10.

Secondly, a waste conveyance flow for washing down waste will be described.

As depicted in FIG. 1B, a main stream of the waste conveyance flow B with the waste C flows down along part of a peripheral wall of the fall path 8*c* on the side opposite to the rise path 8*b*, as indicated by the arrowed line B1. Then, the main stream of the waste conveyance flow B with the waste C as indicated by the arrowed line B1 flows at a timing later than the leading flush water A as indicated by the arrowed line A1. The main stream of the waste conveyance flow B with the waste C passes by a cutout-like portion 36 of the peripheral wall 34*a* of the downward flow passage 34, as indicated by the arrowed line B2. The main stream of the waste conveyance flow B with the waste C further flows down through the downward flow passage 34 as indicated by the arrowed line B3, so that colliding with the bottom wall surface 50 of the delaying flow passage 228 and flowing into the delaying flow passage 228 can be suppressed.

As depicted in FIG. 10, the leading flush water A flowing out to the downward flow passage 34 through the exit 244 merges with the main stream of the waste conveyance flow B with the waste C, as indicated by the arrowed line A10. As mentioned above, the leading flush water A having flowed into the delaying flow passage 228 passes through the bypass flow passage comprising the connection zone 246 and the extended flow passage 248 and having a given distance, until it flows out toward the downward flow passage 34 through the exit 244. In this process, a given time has elapsed. Further, the leading flush water A passing through the bypass flow passage has a relatively low flow speed, and the waste conveyance flow B as a trailing flow has a relatively high flow speed. Thus, the leading flush water A having flowed into the delaying flow passage 228 merges with a waste conveyance flow B reaching the downward flow passage 34 of the flow dividing section 26 at a delayed timing after an elapse of a given time since the inflow of the leading flush water A to the delaying flow passage 228, at a given position of the downward flow passage 34. That is, part of the leading flush water A having flowed into the delaying flow passage 228 is converted to the waste conveyance flow B. This makes it possible to add the leading flush water A contributing less to conveyance of the waste C, to the waste conveyance flow B, and thus increase the volume of the waste conveyance flow B as indicated by the arrowed line B4, thereby improving a capability of conveying the waste C (waste conveyance capability). The arrowed line B4 indicates the improved waste conveyance flow B which is increased in terms of flow rate and/or volume based on merging of the leading flush water A and the waste conveyance flow B.

Next, with reference to FIG. 11, a third modification of the flush toilet according to the first embodiment will be described.

In the third modification, the same element or component as that in the above first embodiment is assigned with the same reference numeral or sign, and its description will be omitted.

In the first embodiment, the discharge socket 16 communicated with the discharge trap pipe 8 and configured to discharge waste to the downstream building sewer pipe 22 is a resin member which is a separate component from the toilet main unit 2. However, the first embodiment may be modified to comprise a discharge conduit 316 which is one element integrally formed with the toilet main unit 2. The toilet main unit 2 and the discharge conduit 316 integrally formed together may be made of a ceramic material or may be made of a resin material.

Figure 11:
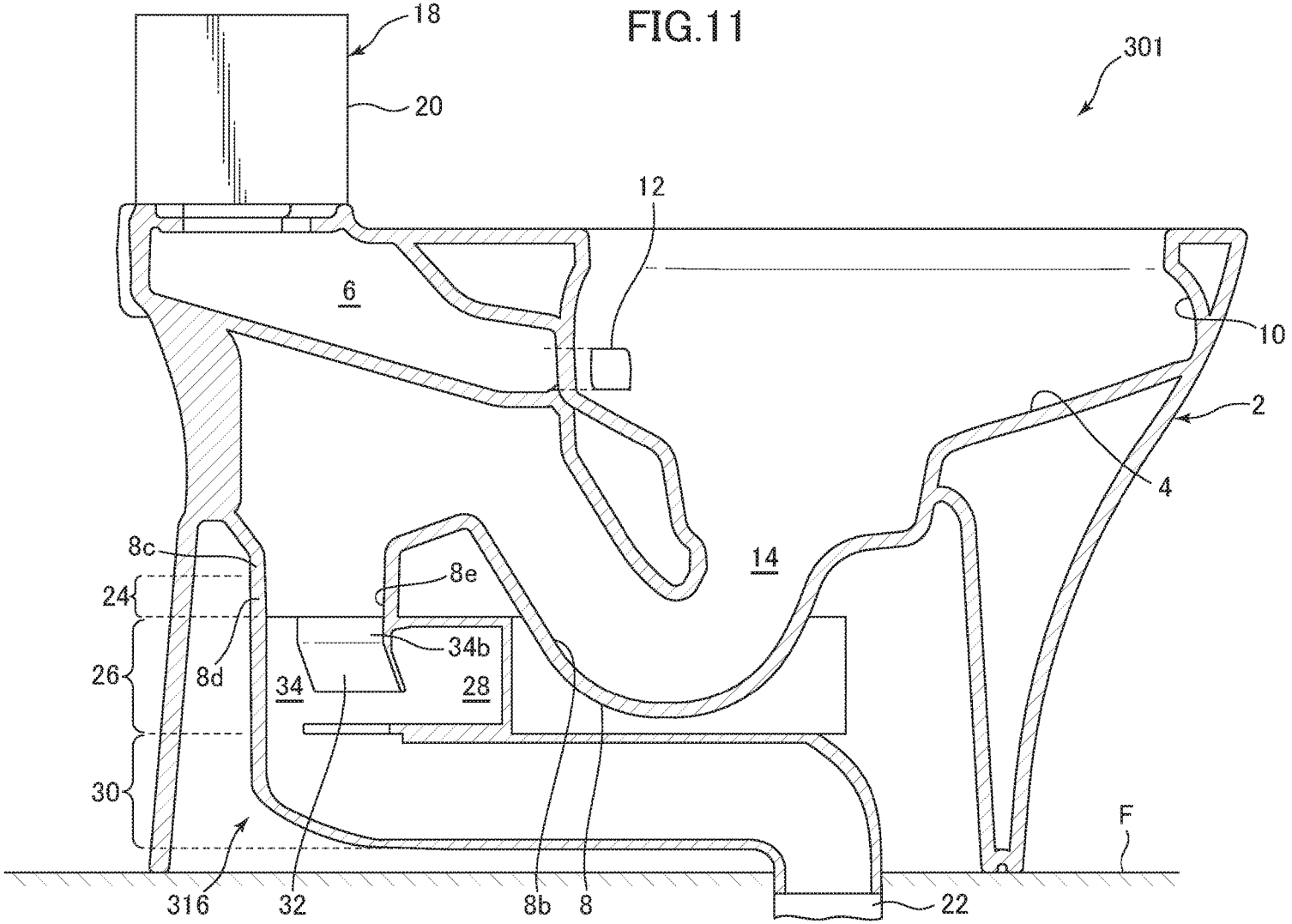
FIG. 11 is a sectional view depicting a third modification of the flush toilet according to the first embodiment, wherein the discharge socket and the toilet main unit in the flush toilet according to the first embodiment are integrally formed.

Specifically, as depicted in FIG. 11, a flush toilet 301 in the third modification comprises a discharge socket 316 communicated with a discharge trap pipe 8 and configured to discharge waste to a downstream building sewer pipe 22. The discharge socket 316 is a member made of a ceramic material and formed as one element integral with a toilet main unit 2.

The discharge socket 316 comprises an upstream discharge conduit section 24, a flow dividing section 26, a delaying flow passage 28, and a downstream discharge conduit section 30, which are arranged approximately in this order in a direction from an upstream end to a downstream end thereof. A fall path 8*c* of a discharge trap pipe 8 and the upstream discharge conduit section 24 of the discharge socket 316 are connected as an integral member, and thus an outlet 8*d* of the discharge trap pipe 8 is formed such that an inner peripheral surface 8*e* thereof is approximately flush with an introduction surface 34*b* of the flow dividing section 26 of the discharge socket 316.

In the flush toilet (1, 301) according to the first embodiment and the modifications thereof (hereinafter referred to collectively as "first embodiment"), during toilet flushing, the flow dividing section 26 enables at least part of relatively low-speed flush water flowing on the leading side of the waste (leading flush water) to flow into the delaying flow passage (28, 128, 228), and the delaying flow passage (28, 128, 228) enables flush water having flowed thereinto to merge with a flow of the relatively high-speed flush water for washing down or convey the waste (waste conveyance flow), which reaches the flow dividing section 26 at a timing after the inflow of the flush water to the delaying flow passage (28, 128, 228). In this process, the delaying flow passage (28, 128, 228) forms a flow passage in the lateral region E between the discharge trap pipe 8 and the skirt portion 9, so that it is possible to expand the delaying flow passage (28, 128, 228) to a wider region on the side of the lateral region E to increase the bottom surface area of the delaying flow passage (28, 128, 228). This can make it easier to enable the leading flush water to flow into the delaying flow passage (28, 128, 228) in a larger volume. Therefore, even in a situation where the volume of flush water is reduced in order to cope with demand for water-saving, the flush toilet (1, 301) according to the first embodiment can enable the leading flush water to flow out through the delaying flow passage (28, 128, 228) in a larger volume so as to merge with the waste conveyance flow, i.e., can increase the volume of the waste conveyance flow, thereby improving a capability of conveying waste (waste conveyance capability).

In the case where, due to difficulty in forming the delaying flow passage (28, 128, 228) in the lateral region, the delaying flow passage is formed only in the central region D, i.e., it is impossible to increase the bottom surface area toward a lateral side, it is conceivable to form the delaying flow passage (28, 128, 228) in such a manner as to expand an internal space thereof in an upward-downward direction, to thereby increase the volume of flush water flowing through the delaying flow passage. In this case, however, when the flow speed of flush water flowing into the delaying flow passage (28, 128, 228) is fairly small, it is difficult to raise a water level, i.e., increase the volume of flush water flowing through the delaying flow passage (28, 128, 228). In the flush toilet (1, 301) according to the first embodiment, by forming the delaying flow passage (28, 128, 228) in the lateral region E to increase the bottom surface area of the delaying flow passage (28, 128, 228) in the lateral region E, it becomes possible to more reliably increase the volume of flush water flowing through the delaying flow passage (28, 128, 228), irrespective of the flow speed of inflowing flush water. This makes it possible to enable the leading flush water to flow out through the delaying flow passage (28, 128, 228) in a larger volume so as to merge with the waste conveyance flow.

In the flush toilet (1, 301) according to the first embodiment, the connection zone (46, 146, 246) enables the flow direction of flush water having flowed thereinto from the flow dividing section 26 to be changed toward the lateral region E, so that it is possible to reduce the flow speed of the leading flush water flowing through the extended flow passage (48, 148, 248), and increase a period of time during which the leading flush water flows through the extended flow passage (48, 148, 248). This makes it possible to suppress a situation where the leading flush water having flowed into the delaying flow passage (28, 128, 228) flows out to the flow dividing section 26 before the waste conveyance flow reaches the flow dividing section 26. Thus, it becomes possible to enable the leading flush water to flow out through the delaying flow passage (28, 128, 228) in a larger volume so as to more reliably merge with the waste conveyance flow B.

In the flush toilet (1, 301) according to the first embodiment, the extended flow passage (48, 148, 248) provided in each of the first and second side regions of the lateral region E on both lateral sides of the central region D can expand the delaying flow passage (28, 128, 228) to a wider region on the side of the lateral region E to increase the bottom surface area of the delaying flow passage (28, 128, 228). This can make it easier to enable the leading flush water to flow into the delaying flow passage (28, 128, 228) in a larger amount.

In the flush toilet (1, 301) according to the first embodiment, the extended flow passage (48, 148, 248) extends in a direction along the direction connecting the inlet 8*f* and the outlet 8*d* of the discharge trap pipe 8, so that it is possible to expand the delaying flow passage (28, 128, 228) to a wider region on the side of the lateral region E to further increase the bottom surface area of the delaying flow passage (28, 128, 228). This can make it easier to enable the leading flush water to flow into the delaying flow passage (28, 128, 228) in a larger amount.

In the flush toilet (1, 301) according to the first embodiment, the extended flow passage (48, 148, 248) extends to reach a position where the extended flow passage partially overlaps the discharge trap pipe 8, in side view, so that it is possible to expand the delaying flow passage (28, 128, 228) to a wider region on the side of the lateral region E to further increase the bottom surface area of the delaying flow passage (28, 128, 228). This can make it easier to enable the leading flush water to flow into the delaying flow passage (28, 128, 228) in a larger amount.

In the flush toilet (1, 301) according to the first embodiment, during toilet flushing, during toilet flushing, when the high-speed waste conveyance flow B flows from the rise path 8*b* of the discharge trap pipe 8 into the downward flow passage 34 of the flow dividing section 26, the waste conveyance flow B flows down through part of the peripheral wall of the downward flow passage 34 on the side opposite to the rise path 8*b* of the discharge trap pipe 8, because the momentum of the high-speed waste conveyance flow B is relatively strong. On the other hand, during toilet flushing, the low-speed leading flush water flows down through the remaining part of the peripheral wall of the downward flow passage 34 on the side of the rise path 8*b* of the discharge trap pipe 8, because the momentum of the low-speed flush water is relatively weak. This can make it less likely for the waste conveyance flow to flow into the delaying flow passage (28, 128, 228), while selectively enabling the low-speed leading flush water to flow into the delaying flow passage (28, 128, 228) in a more reliable manner.

In the flush toilet (1, 301) according to the first embodiment, differently from the structure in which the connection zone (46, 146, 246) additionally function as an exit (44, 144, 244) of the delaying flow passage (28, 128, 228), it is possible to suppress a situation where a non-flowing state of flush water within the extended flow passage (48, 148, 248) continues for a relatively long period of time. More specifically, it is possible to suppress the occurrence of a situation where a non-flowing state of flush water within the extended flow passage (48, 148, 248) continues for a relatively long period of time and thus a timing of the outflow is delayed to an extent that the flush water cannot merge with the waste conveyance flow. Thus, even when the volume of flush water for toilet flushing is reduced in order to cope with demand for water-saving, it is possible to enable the leading flush water to flow out through the delaying flow passage (28, 128, 228) in a larger volume so as to merge with the conveyance flow. This makes it possible to increase the volume of the waste conveyance flow, thereby improving the waste conveyance capability. Further, it becomes possible to suppress a situation where, due to the non-flowing state of flush water within the extended flow passage (48, 148, 248), floating pieces of waste sink in the flush water and remain in the extended flow passage (48, 148, 248).

In the flush toilet (1, 301) according to the first embodiment, the first extended flow passage 248*a* extending from the connection zone (46, 146, 246) to the first exit 244*a* and the second extended flow passage 248*b* extending from the connection zone (46, 146, 246) to the second exit 244*b* are formed independently of each other. This makes it possible to suppress a situation where a turbulent flow occurs due to merging of respective flush water flows in the first and second extended flow passages 248*a*, 248*b*, and the non-flowing state of flush water within the extended flow passages 248*a*, 248*b* continues for a relatively long period of time.

In the flush toilet 1 according to the first embodiment, the discharge socket (16, 316) is a resin member which is a separate component from the toilet main unit 2. Thus, for example, comparing with case where the discharge socket is made of a ceramic material, it becomes possible to reduce a manufacturing error, and more reliably install the delaying flow passage (28, 128, 228) in the lateral region E.

In the flush toilet (1, 301) according to the first embodiment, the extended flow passage (48, 148, 248) is provided only in the lateral region E. The extended flow passage (48, 148, 248) disposed in the lateral region E becomes less likely to receive restrictions from the shape of the discharge trap pipe 8 and the position of an inlet of the building sewer pipe 22 to be connected to the discharge socket (16, 316). Thus, according to this feature, it becomes possible to apply the extended flow passage (48, 148, 248) to various types of flush toilets adaptable to differences in the shape of the discharge trap pipe 8 and the position of the inlet of the building sewer pipe 22.

In the flush toilet (1, 301) according to the first embodiment, the connection zone (46, 246) and an exit of the delaying flow passage (28, 228) are opened to the flow dividing section 26 located upstream of the transverse flow passage of the downstream discharge conduit section, so that it is possible to cope with differences in the position of the inlet of the building sewer pipe 22 by changing only the length of the transverse flow passage of the downstream discharge conduit section (30, 130) depending on the position of the inlet of the building sewer pipe 22, without changing the length of the delaying flow passage (28, 228). As a way to changing the length of the transverse flow passage, the downstream discharge conduit section (30, 130) may comprise: a linear conduit body of the downstream discharge conduit section (30, 130); a first member for connecting the conduit body to the flow dividing section 26 on an upstream side thereof; and a second member for connecting the conduit body to the building sewer pipe 22 on a downstream side thereof, and the length of the transverse flow passage may be changed by adjustably cutting one end of the linear conduit body.

Next, with reference to FIGS. 12 to 14, a flush toilet 401 according to a second embodiment of the present invention will be described.

In the second embodiment, the same element or component as that in the flush toilet 1 according to the above first embodiment is assigned with the same reference numeral or sign, and its description will be omitted.

Differently from the structure of the flush toilet 1 according to the first embodiment, wherein the guide portion 32 and the delaying flow passage 28 are arranged forward of the vertically-extending flow dividing section 26, a flush toilet 401 according to the second embodiment is configured such that a guide portion 432 and a delaying flow passage 428 are arranged on a lateral side of (in a rightward-leftward direction with respect to) a transversely-extending flow dividing section 426, as described below.

The flush toilet 401 comprises a discharge socket 416 communicated with a discharge trap pipe 8 and configured to discharge waste to a building sewer pipe 22 on a downstream side thereof.

The discharge socket 416 comprises an upstream discharge conduit section 424, a flow dividing section 426, a delaying flow passage 428, and a downstream discharge conduit section 430, which are arranged approximately in this order in a direction from an upstream end to a downstream end thereof. The discharge socket 416 is a resin member which is a separate component from a toilet main unit 2.

The upstream discharge conduit section 424 has an upstream end connected to an outlet 8*d* of the discharge trap pipe 8 (i.e., outlet 8*d* of a fall path 8*c* of the discharge trap pipe 8), and extends approximately parallel to the outlet 8*d* and vertically downwardly. The upstream discharge conduit section 424 extends from a position outside and above the outlet 8*d* of the fall path 8*c* to a bent portion 424*a* as a lower portion thereof.

The downstream discharge conduit section 430 is provided on a downstream side of the flow dividing section 426 extending in a transverse direction. The downstream discharge conduit section 430 extends vertically downwardly from a bent portion 430*a* thereof. The downstream discharge conduit section 430 has a downstream end connected to the building sewer pipe 22 which is disposed below a floor F on which the toilet main unit 2 is placed (see FIG. 1A).

The flow dividing section 426 is provided on a downstream side of the upstream discharge conduit section 424. The flow dividing section 426 is a linear flow passage extending transversely between the upstream discharge conduit section 424 and the downstream discharge conduit section 430. The flow dividing section 426 has a guide portion 432 configured to guide therealong at least part of relatively low-speed flush water (leading flush water) supplied from the discharge trap pipe 8 so as to flow into the delaying flow passage 428. The flow dividing section 426 has a transverse flow passage 434 located inward of the guide portion 432 to extend from an upstream end to a downstream end of the flow dividing section 426 in an approximately transverse direction.

The guide portion 432 of the flow dividing section 426 is formed to extend from laterally opposite regions (right and left regions) of a peripheral wall 434*a* of the transverse flow passage 434, and formed between the transverse flow passage 434 and the delaying flow passage 428. The guide portion 432 is disposed on a lateral side of the transverse flow passage 434. The guide portion 432 extends from an upstream end thereof toward a downstream side to expand the flow passage. The guide portion 432 is formed such that a downstream end thereof is oriented toward an inside of the delaying flow passage 428. The guide portion 432 forms an acute angle $\alpha 2$ with respect to a two-dot chain line Z2 along the transverse flow passage 434 (or a central axis of the transverse flow passage 434). The angle $\alpha 2$ may be set in the range of 5 to 60 degrees, preferably in the range of 5 to 45 degrees, more preferably to 30 degrees. Between the downstream end of the guide portion 432 and a downstream surface 450 of an entrance 440 of the delaying flow passage 428, an inflow opening is formed.

Figure 14:
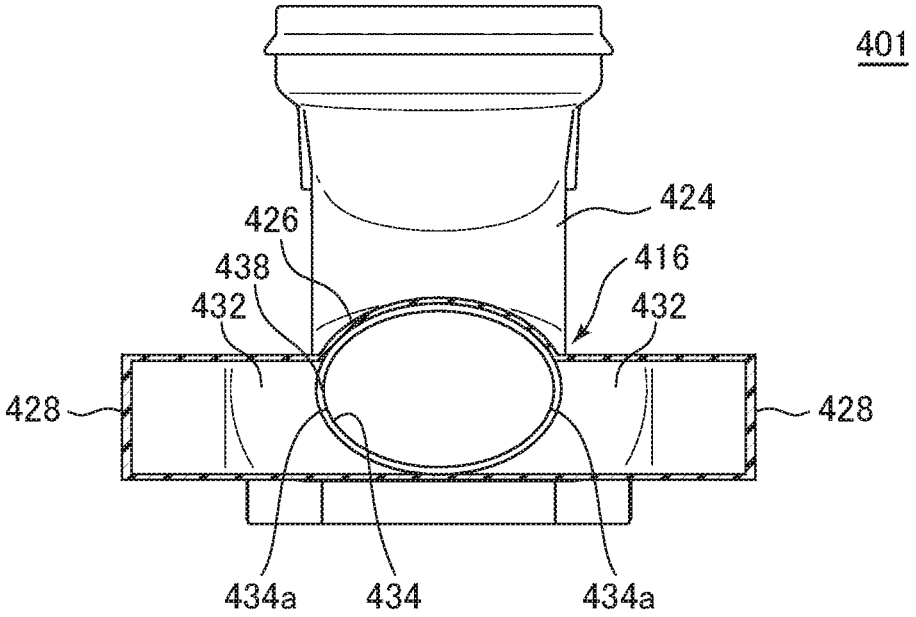
FIG. 14 is a sectional view taken along the line XIV-XIV in FIG. 12.

As depicted in FIG. 14, the guide portion 432 is formed on the right and left regions of the peripheral wall 434*a* of the transverse flow passage 434. The guide portion 432 is formed along approximately one-half or more of the entire circumstance of the peripheral wall 434*a* of the transverse flow passage 434.

Figure 13:
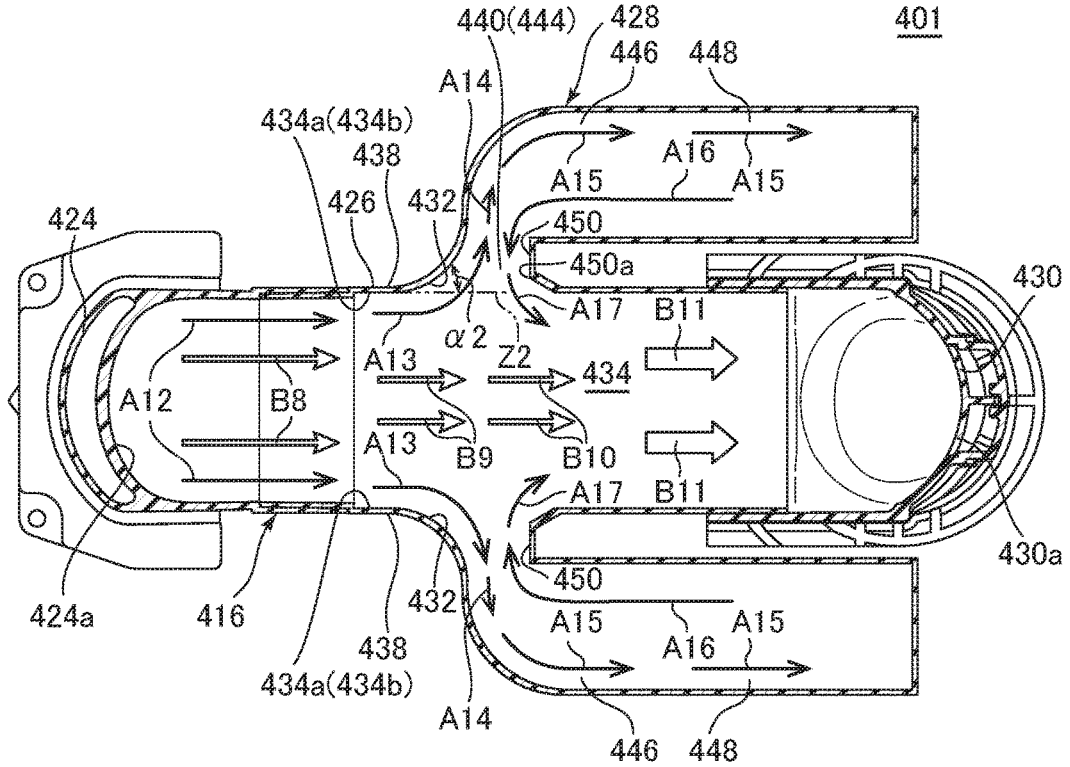
FIG. 13 is a sectional view taken along the line XIII-XIII in FIG. 12.

As depicted in FIG. 13, a connection portion 438 between the peripheral wall 434*a* of the transverse flow passage 434 and the guide portion 432 of the flow dividing section 426 is formed to have a smoothly curved surface. The peripheral wall 434*a* of the transverse flow passage 434 of the flow dividing section 426 is formed to have an introduction surface 434*b* which extends approximately linearly in a transverse direction to the upstream end of the guide portion 432.

Figure 12:
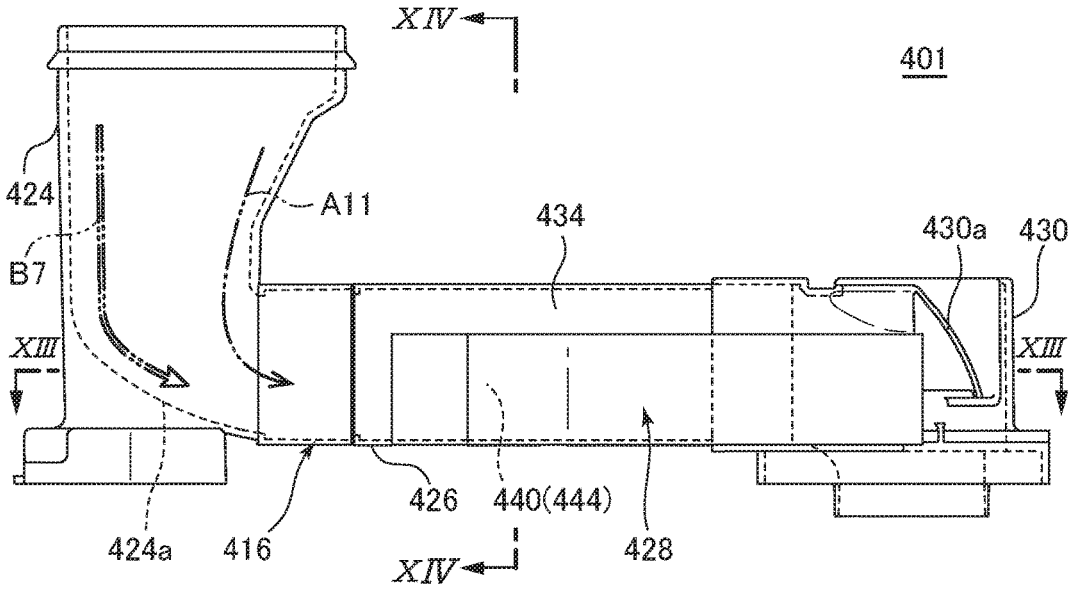
FIG. 12 is a side view depicting a discharge socket in a flush toilet according to a second embodiment of the present invention, wherein an internal passage of the discharge socket is indicated.

As depicted in FIGS. 12 to 14, the delaying flow passage 428 is formed as a flow passage branched rightwardly and leftwardly from the flow dividing section 426. The delaying flow passage 428 forms a flow passage in a lateral region E. The delaying flow passage 428 is disposed on a lateral side of the guide portion 432. The delaying flow passage 428 is formed bilaterally symmetrically with respect to a longitudina axis of the toilet main unit 2. Although the delaying flow passage 428 is disposed on the right and left sides with respect to the flow dividing section 426, it is to be understood that it may be disposed on only one of the right and left sides with respect to the flow dividing section 426.

The delaying flow passage 428 comprises a connection zone 446 connecting with the flow dividing section 426, and an extended flow passage 448 extending from the connection zone 446 toward the lateral region E.

The connection zone 446 has an entrance 440 for accepting flush water guided along the guide portion 432. This entrance 440 also functions as an exit 444 for enabling flush water having flowed into the connection zone 446 to flow out therefrom. The connection zone 446 further functions as a reservoir chamber for enabling flush water having flowed thereinto from the entrance 440 to flow thereinside so as to temporarily stay therein. The entrance 440 is located downstream and outside the guide portion 432. The entrance 440 is located on the lateral side of the transverse flow passage 434 of the flow dividing section 426, and formed as an opening including about a lower half of the entire circumstance of the peripheral wall 434*a* of the transverse flow passage 434. That is, the delaying flow passage 428 is a reservoir-type delaying flow passage in which a single opening is used as both of the entrance 440 and the exit 444, and flush water temporarily stays therein while flowing thereinside. Further, the connection zone 446 forms a bent flow passage for changing a flow direction of flush water having flowed thereinto from the flow dividing section 426, toward the lateral region E on a lateral side thereof. The connection zone 446 forming the bent flow passage makes it possible to reduce the flow speed of flush water flowing thereinside. Thus, by enabling flush water to flow inside the connection zone 446, it becomes possible to delay a timing at which this flush water flows through the discharge socket 416, with respect to an initial state. Based on this mechanism, the delaying flow passage 428 makes it possible for flush water having flowed thereinto along the guide portion 432 of the flow dividing section 426 to merge with a flush water flow reaching the flow dividing section 426 at a timing after the inflow of the flush water to the delaying flow passage 428, in a delayed manner. The connection zone 446 and the extended flow passage 448 are formed such that a bottom wall surface thereof is like a plane and slightly inclines downwardly toward the entrance 440.

The extended flow passage 448 is provided in each of first and second side regions of the lateral region E on both sides of a central region D. Alternatively, the extended flow passage 448 may be provided in only one of the first and second side regions of the lateral region E on both sides of the central region D. Further, although the extended flow passage 448 in the second embodiment is provided only in the lateral region E, the extended flow passage 448 may be provided in each of the central region D and the lateral region E. The extended flow passage 448 extends in a direction along the discharge trap pipe 8, i.e., a forward-rearward (longitudinal) direction of the toilet main unit 2. In side view, the extended flow passage 448 extends from a position beneath the fall path 8*c* of the discharge trap pipe 8 to a position corresponding to a front end of the discharge trap pipe 8. The extended flow passage 448 extends the delaying flow passage 428 to an inside of the lateral region E. The extended flow passage 448 expands the delaying flow passage 428 to a wider region in the lateral region E to increase a bottom surface area of the delaying flow passage 428. The bottom surface area of the delaying flow passage 428 is increased by the extended flow passage 448, as mentioned above. Thus, even in a situation where the flow speed of inflowing flush water is fairly low, it is possible to make it easier to enable the flush water to flow into a wider region of the delaying flow passage 428, and thus make it easier to enable the flush water to flow into the delaying flow passage 428 in a larger volume, as compared to case where the delaying flow passage 428 has a smaller bottom surface area. Thus, by forming the delaying flow passage 428 in the lateral region E to increase the bottom surface area of the delaying flow passage 428 in the lateral region E, it becomes possible to more reliably increase the volume of flush water flowing through the delaying flow passage, irrespective of the flow speed of inflowing flush water. The extended flow passage 448 additionally functions as a reservoir chamber for allowing flush water to temporarily stay therein. The extended flow passage 448 is configured to reduce the flow speed of flush water having flowed thereinto, during a course in which flush water having flowed thereinto from the connection zone 446 flows therethrough while turning back toward the connection zone 446.

As depicted in FIG. 13, the delaying flow passage 428 is formed such that a downstream surface 450 defining the entrance 440 thereof protrudes inside the flow dividing section 426 to a position downstream of and opposed to the guide portion 432 of the flow dividing section 426. An edge 450*a* of the downstream surface 450 of the delaying flow passage 428 is located outward of the transverse flow passage 434, in side view as viewed from an upstream end of the transverse flow passage 434.

In the second embodiment, the discharge socket 416 communicated with the discharge trap pipe 8 and configured to discharge waste to the downstream building sewer pipe 22 is a resin member which is a separate component from the toilet main unit 2. However, the second embodiment may be modified to comprise a discharge conduit which is one element integrally formed with the toilet main unit 2. The toilet main unit 2 and the discharge conduit integrally formed together may be made of a ceramic material or may be made of a resin material.

With reference to FIGS. 1A, 1B and 12 to 14, an operation (function) of the flush toilet according to the second embodiment will be described below.

Specifically, a state when draining is performed along with toilet flushing in the flush toilet according to the second embodiment will be described with reference to FIGS. 1A, 1B and 12 to 14. In FIGS. 1A, 1B, 12 and 13, a flow of leading flush water, i.e., relatively low-speed flush water flowing on a leading side of waste C, is indicated by the arrowed lines A (A0, A1, A11 to A17), and a waste conveyance flow, i.e., relatively high-speed flush water mainly flowing on a trailing side of the waste C to wash down or convey the waste C, is indicated by the arrowed lines B (B0, B1, B7 to B11). The toilet main unit 2 of the flush toilet 401 according to the second embodiment is approximately the same as that of the toilet main unit 2 of the flush toilet 1 according to the first embodiment. Thus, a flow of flush water in the toilet main unit 2 of the flush toilet 401 will be described primarily with reference to FIGS. 1A and 1B. Further, in the second embodiment, the same element or component as that of the flush toilet 1 according to the first embodiment is assigned with the same reference numeral or sign, and its description will be omitted.

Firstly, a state in which relatively low-speed flush water is flowing on the leading side of the waste C will be described.

As depicted in FIG. 1A, at a start of toilet flushing in the flush toilet 401, relatively low-speed flush water A flows on the leading side of the waste C, as indicated by the arrowed line A0. The relatively low-speed leading flush water A has weak momentum, and thus flows down along part of the inner peripheral surface 8*e* of the fall path 8*c* on the side of an rise path 8*b*, as indicated by the arrowed line A1.

The leading flush water A having flowed down into the upstream discharge conduit section 424 flows downwardly as indicated by the arrowed line A11 in FIG. 12, and then flows into the flow dividing section 426. The leading flush water A having flowed down into the flow dividing section 426 flows transversely through the transverse flow passage 434, as indicated by the arrowed lines A12 in FIG. 13. The leading flush water A has a relatively low flow rate, so that it is more likely to spread laterally in the transverse flow passage 434. The leading flush water A flows along the peripheral wall 434*a* of the transverse flow passage 434 toward the guide portion 432 via the introduction surface 434*b*, and is then guided along the guide portion 432 toward the delaying flow passage 428, as indicated by the arrowed lines A13. The leading flush water A is drawn to the guide portion 432 by the Coanda effect, so that a flow direction thereof is changed to a direction along which the guide portion 432 extends. In this way, at least part of the leading flush water A flows into the entrance 440 of the delaying flow passage 428, as indicated by the arrowed lines A14. The leading flush water A having flowed into the connection zone 446 flows from the connection zone 446 toward the extended flow passage 448, as indicated by the arrowed lines A15. The flow direction of the leading flush water A is changed within the connection zone 446, so that the flow speed of the leading flush water A is reduced as compared to that at a timing of the inflow to the delaying flow passage 428. As a result of flowing through the connection zone 446 and the extended flow passage 448, the leading flush water A is delayed with respect to a flow of flush water flowing through the transverse flow passage 434 as a main flow passage. The leading flush water A gently flows in such a manner as to be temporarily held in the connection zone 446 and the extended flow passage 448, and then returns to the main stream. When the volume of flush water flowing into the entrance 440 of the delaying flow passage 428 becomes small or zero after elapse of a given time from the start of toilet flushing, the leading flush water A having flowed into the connection zone 446 and the extended flow passage 448 flows toward the exit 444 and then flows out toward the transverse flow passage 434 through the exit 444, as indicated by the arrowed lines A16.

Secondly, a waste conveyance flow for washing down waste will be described.

As depicted in FIGS. 1A and 1B, at a start of toilet flushing, according to a water flow action caused by drop of flush water from a water conducting passage 6 to a water pooling region 14, a waste conveyance flow B for strongly washing down waste is formed.

The waste conveyance flow B acting to wash down the waste C flows around the waste C and mainly on the trailing side of the waste C, as indicated by the arrowed line B0. A main stream of the waste conveyance flow B with the waste C flows down along part of a peripheral wall of the fall path 8*c* on the side opposite to the rise path 8*b*, as indicated by the arrowed line B1. Then, the main stream of the waste conveyance flow B with the waste C as indicated by the arrowed line B1 flows at a timing later than the leading flush water A as indicated by the arrowed line A1. The main stream of the waste conveyance flow B with the waste C, having flowed down into the upstream discharge conduit section 424, flows downwardly as indicated by the arrowed line B7 in FIG. 12, and then flows into the flow dividing section 426. The main stream of the waste conveyance flow B with the waste C, having flowed into the flow dividing section 426, flows transversely through the transverse flow passage 434, as indicated by the arrowed lines B8 in FIG. 13. The main stream of the waste conveyance flow B with the waste C has a relatively high flow rate, so that it is less likely to spread laterally in the transverse flow passage 434, i.e., tends to flow straight through the transverse flow passage 434. Thus, the main stream of the waste conveyance flow B with the waste C flows straight as indicated by the arrowed lines B9, so that it is less likely to be guided along the guide portion 432 toward the delaying flow passage 428. In this process, the main stream of the waste conveyance flow B with the waste C as indicated by the arrowed lines B9 passes through a cutout-like portion formed in lower region of the peripheral wall 434*a* of the transverse flow passage 434. The main stream of the waste conveyance flow B with the waste C further flows down through the transverse flow passage 434 as indicated by the arrowed lines B10, so that colliding with the downstream surface 450 of the entrance 440 of the connection zone 446 and flowing into the delaying flow passage 428 can be suppressed.

As regards the leading flush water A having a relatively low flow speed, a relatively large proportion by volume of leading flush water A flowing from the upstream discharge conduit section 424 is guided to the delaying flow passage 428 along the guide portion 432. On the other hand, as regards the waste conveyance flow B having a relatively high flow speed, a relatively small proportion by volume of a waste conveyance flow B flowing from the upstream discharge conduit section 424 is guided to the delaying flow passage 428 along the guide portion 432. Thus, a rate of part of the leading flush water A to be guided to the delaying flow passage 428 along the guide portion 432 is greater than a rate of part of the waste conveyance flow B to be guided to the delaying flow passage 428 along the guide portion 432. In this case, the rate of the part of the waste conveyance flow B to be guided to the delaying flow passage 428 along the guide portion 432 is 0% or more.

The leading flush water A flowing out to the transverse flow passage 434 through the exit 444 merges with the waste conveyance flow B, as indicated by the arrowed lines A17. As mentioned above, the leading flush water A having flowed into the connection portion 446 flows inside the delaying flow passage 428 until it flows out toward the transverse flow passage 434 through the exit 444. In this process, a given time has elapsed. Thus, the leading flush water A in the delaying flow passage 428 merges with a waste conveyance flow B reaching the transverse flow passage 434 of the flow dividing section 426 at a timing after a given time has elapsed since the inflow of the leading flush water A to the delaying flow passage 428. That is, part of the leading flush water A having flowed into the delaying flow passage 428 is converted to the waste conveyance flow B.

This makes it possible to add the leading flush water A contributing less to conveyance of the waste C, to the waste conveyance flow B, and thus increase the volume of the waste conveyance flow B as indicated by the arrowed lines B11, thereby improving a capability of conveying the waste C (waste conveyance capability). The arrowed lines B11 indicate the improved waste conveyance flow B which is increased in terms of flow rate and/or volume based on merging of the leading flush water A and the waste conveyance flow B.

The improved waste conveyance flow B with the waste C flows toward the downstream discharge conduit section 430, and is then discharged into the building sewer pipe 22.

In the flush toilet 401 according to the second embodiment, during toilet flushing, the flow dividing section 426 enables at least part of relatively low-speed flush water flowing on the leading side of the waste (leading flush water) to flow into the delaying flow passage 428, and the delaying flow passage 428 enables flush water having flowed thereinto to merge with a flow of the relatively high-speed flush water for washing down or convey the waste (waste conveyance flow), which reaches the flow dividing section 426 at a timing after the inflow of the flush water to the delaying flow passage 428. In this process, the delaying flow passage 428 forms a flow passage in the lateral region E between the discharge trap pipe 8 and the skirt portion 9, so that it is possible to expand the delaying flow passage 428 to a wider region on the side of the lateral region E to increase the bottom surface area of the delaying flow passage 428. This can make it easier to enable the leading flush water to flow into the delaying flow passage 428 in a larger volume. Therefore, even in a situation where the volume of flush water is reduced in order to cope with demand for water-saving, the flush toilet 401 according to the second embodiment can enable the leading flush water to flow out through the delaying flow passage 428 in a larger volume so as to merge with the waste conveyance flow, i.e., can increase the volume of the waste conveyance flow, thereby improving a capability of conveying waste (waste conveyance capability).

In the case where, due to difficulty in forming the delaying flow passage 428 in the lateral region, the delaying flow passage is formed only in the central region D, i.e., it is impossible to increase the bottom surface area toward a lateral side, it is conceivable to form the delaying flow passage 428 in such a manner as to expand an internal space thereof in an upward-downward direction, to thereby increase the volume of flush water flowing through the delaying flow passage. In this case, however, when the flow speed of flush water flowing into the delaying flow passage 428 is fairly small, it is difficult to raise a water level, i.e., increase the volume of flush water flowing through the delaying flow passage 428. In the flush toilet 401 according to the second embodiment, by forming the delaying flow passage 428 in the lateral region E to increase the bottom surface area of the delaying flow passage 428 in the lateral region E, it becomes possible to more reliably increase the volume of flush water flowing through the delaying flow passage 428, irrespective of the flow speed of inflowing flush water. This makes it possible to enable the leading flush water to flow out through the delaying flow passage 428 in a larger volume so as to merge with the waste conveyance flow.

In the flush toilet 401 according to the second embodiment, the connection zone 446 enables the flow direction of flush water having flowed thereinto from the flow dividing section 426 to be changed toward the lateral region E, so that it is possible to reduce the flow speed of the leading flush water flowing through the extended flow passage 448, and increase a period of time during which the leading flush water flows through the extended flow passage 448. This makes it possible to suppress a situation where the leading flush water having flowed into the delaying flow passage 428 flows out to the flow dividing section 426 before the waste conveyance flow reaches the flow dividing section 426. Thus, it becomes possible to enable the leading flush water to flow out through the delaying flow passage 428 in a larger volume so as to more reliably merge with the waste conveyance flow B.

In the flush toilet 401 according to the second embodiment, the extended flow passage 448 provided in each of the first and second side regions of the lateral region E on both lateral sides of the central region D can expand the delaying flow passage 428 to a wider region on the side of the lateral region E to increase the bottom surface area of the delaying flow passage 428. This can make it easier to enable the leading flush water to flow into the delaying flow passage 428 in a larger amount.

In the flush toilet 402 according to the second embodiment, the extended flow passage 448 extends in a direction along the direction connecting the inlet 8*f* and the outlet 8*d* of the discharge trap pipe 8, so that it is possible to expand the delaying flow passage 428 to a wider region on the side of the lateral region E to further increase the bottom surface area of the delaying flow passage 428. This can make it easier to enable the leading flush water to flow into the delaying flow passage 428 in a larger amount.

In the flush toilet 401 according to the second embodiment, the discharge socket 416 is a resin member which is a separate component from the toilet main unit 2. Thus, for example, comparing with case where the discharge socket is made of a ceramic material, it becomes possible to reduce a manufacturing error, and more reliably install the delaying flow passage 428 in the lateral region E.

In the flush toilet 401 according to the second embodiment, the extended flow passage 448 is provided only in the lateral region E. The extended flow passage 448 disposed in the lateral region E becomes less likely to receive restrictions from the shape of the discharge trap pipe 8 and the position of an inlet of the building sewer pipe 22 to be connected to the discharge socket 416. Thus, according to this feature, it becomes possible to apply the extended flow passage 448 to various types of flush toilets adaptable to differences in the shape of the discharge trap pipe 8 and the position of the inlet of the building sewer pipe 22.

Figure 15:
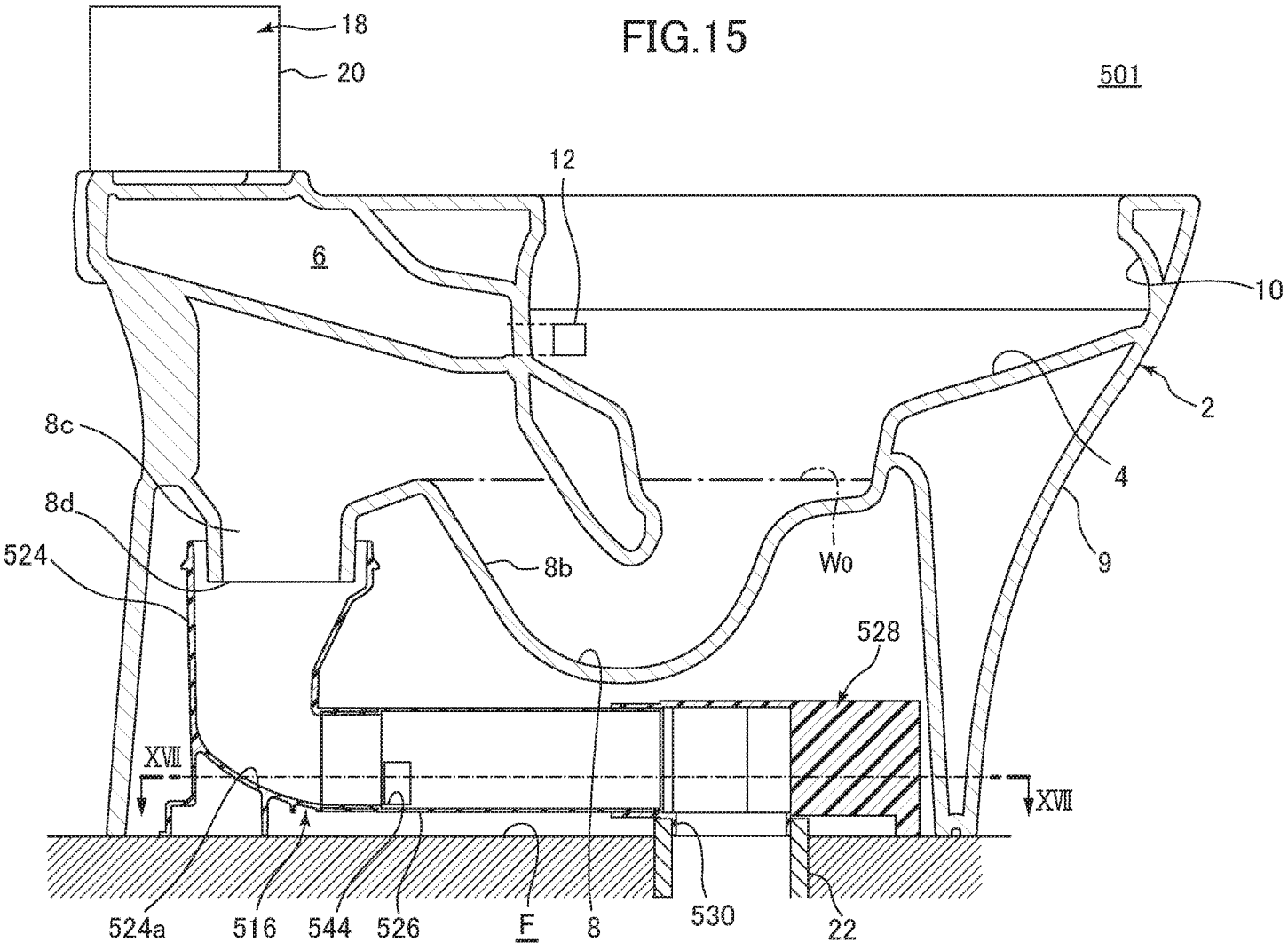
FIG. 15 is a sectional view depicting a flush toilet according to a third embodiment of the present invention.

Next, with reference to FIGS. 15 to 17, a flush toilet 501 according to a third embodiment of the present invention will be described.

In the third embodiment, the same element or component as that in the flush toilet 1 according to the above first embodiment is assigned with the same reference numeral or sign, and its description will be omitted.

Differently from the structure of the flush toilet 1 according to the first embodiment, wherein the guide portion 32 and the delaying flow passage 28 are arranged forward of the vertically-extending flow dividing section 26, a flush toilet 501 according to the third embodiment is configured such that a guide portion 532 and a delaying flow passage 528 are arranged on a lateral side of (in a rightward-leftward direction with respect to) a transversely-extending flow dividing section 526, and an entrance 540 and an exit 544 of the delaying flow passage 528 are separately arranged to form a bypass flow passage, as described below.

The flush toilet 501 comprises a discharge socket 516 communicated with a discharge trap pipe 8 and configured to discharge waste to a building sewer pipe 22 on a downstream side thereof.

The discharge socket 516 comprises an upstream discharge conduit section 524, a flow dividing section 526, a delaying flow passage 528, and a downstream discharge conduit section 530, which are arranged approximately in this order in a direction from an upstream end to a downstream end thereof. The discharge socket 516 is a resin member which is a separate component from a toilet main unit 2.

The upstream discharge conduit section 524 has an upstream end connected to an outlet 8*d* of the discharge trap pipe 8 (i.e., outlet 8*d* of a fall path 8*c* of the discharge trap pipe 8), and extends approximately parallel to the outlet 8*d* and vertically downwardly. The upstream discharge conduit section 524 extends from a position outside and above the outlet 8*d* of the fall path 8*c* to a bent portion 524*a* as a lower portion thereof.

The downstream discharge conduit section 530 is provided on a downstream side of the flow dividing section 526 extending in a transverse direction. The downstream discharge conduit section 530 extends vertically downwardly from a downstream end of the flow dividing section 526. The downstream discharge conduit section 530 has a downstream end connected to the building sewer pipe 22 which is disposed below a floor F on which the toilet main unit 2 is placed.

The flow dividing section 526 is provided on a downstream side of the upstream discharge conduit section 524. The flow dividing section 526 is a linear transverse flow passage extending transversely between the upstream discharge conduit section 524 and the downstream discharge conduit section 530. The flow dividing section 526 has a guide portion 532 configured to guide at least part of relatively low-speed flush water (leading flush water) supplied from the discharge trap pipe 8 along the guide portion 532 to the delaying flow passage 528. The flow dividing section 526 further has a transverse flow passage 534 located inward of the guide portion 532 to extend from an upstream end to the downstream end of the flow dividing section 526 in an approximately transverse direction.

The guide portion 532 of the flow dividing section 526 is formed to extend from laterally opposite regions (right and left regions) of a peripheral wall 534*a* of the transverse flow passage 534, and formed between the transverse flow passage 534 and the delaying flow passage 528. The guide portion 532 is disposed on a lateral side of the transverse flow passage 534. The guide portion 532 is formed such that it extends from an upstream end to a downstream end thereof to expand the flow passage, and the downstream end thereof is oriented toward an inside of the delaying flow passage 528. Between the downstream end of the guide portion 532 and a downstream surface 550 of an entrance 540 of the delaying flow passage 528, an inflow opening is formed.

Figure 17:
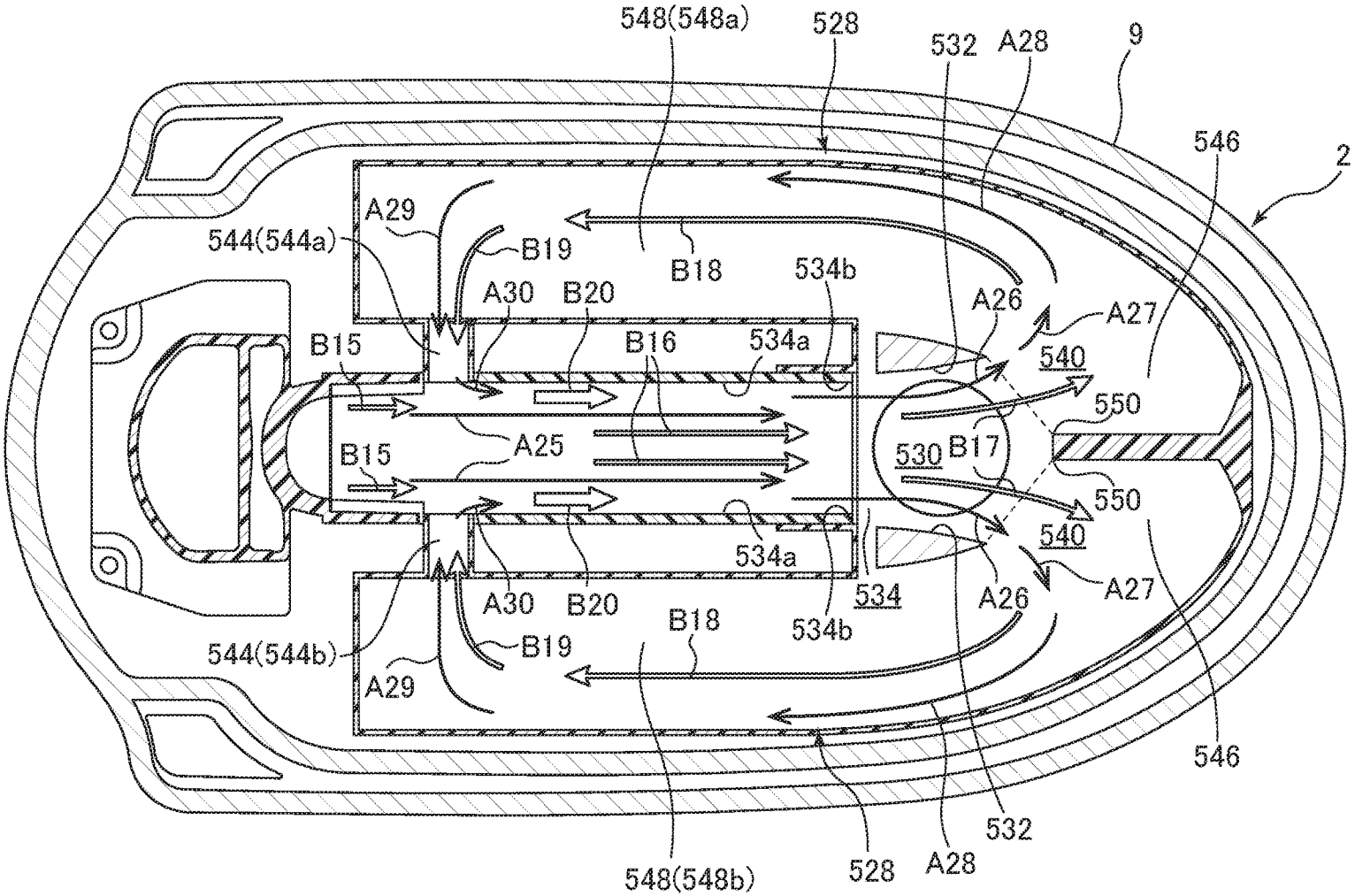
FIG. 17 is a sectional view taken along the line XVII-XVII in FIG. 15.

As depicted in FIG. 17, the guide portion 532 is formed on the right and left regions of the peripheral wall 534*a* of the transverse flow passage 534. The downstream discharge conduit section 530 is connected to a bottom wall surface of the flow dividing section 526 at a position inside the guide portion 532. The guide portion 532 of the flow dividing section 526 has a flat surface which is approximately an extension of the peripheral wall 534*a* of the transverse flow passage 534. That is, the peripheral wall 534*a* of the transverse flow passage 534 has an introduction surface 534*b* extending approximately transversely and linearly toward the upstream end of the guide portion 532.

Figure 16:
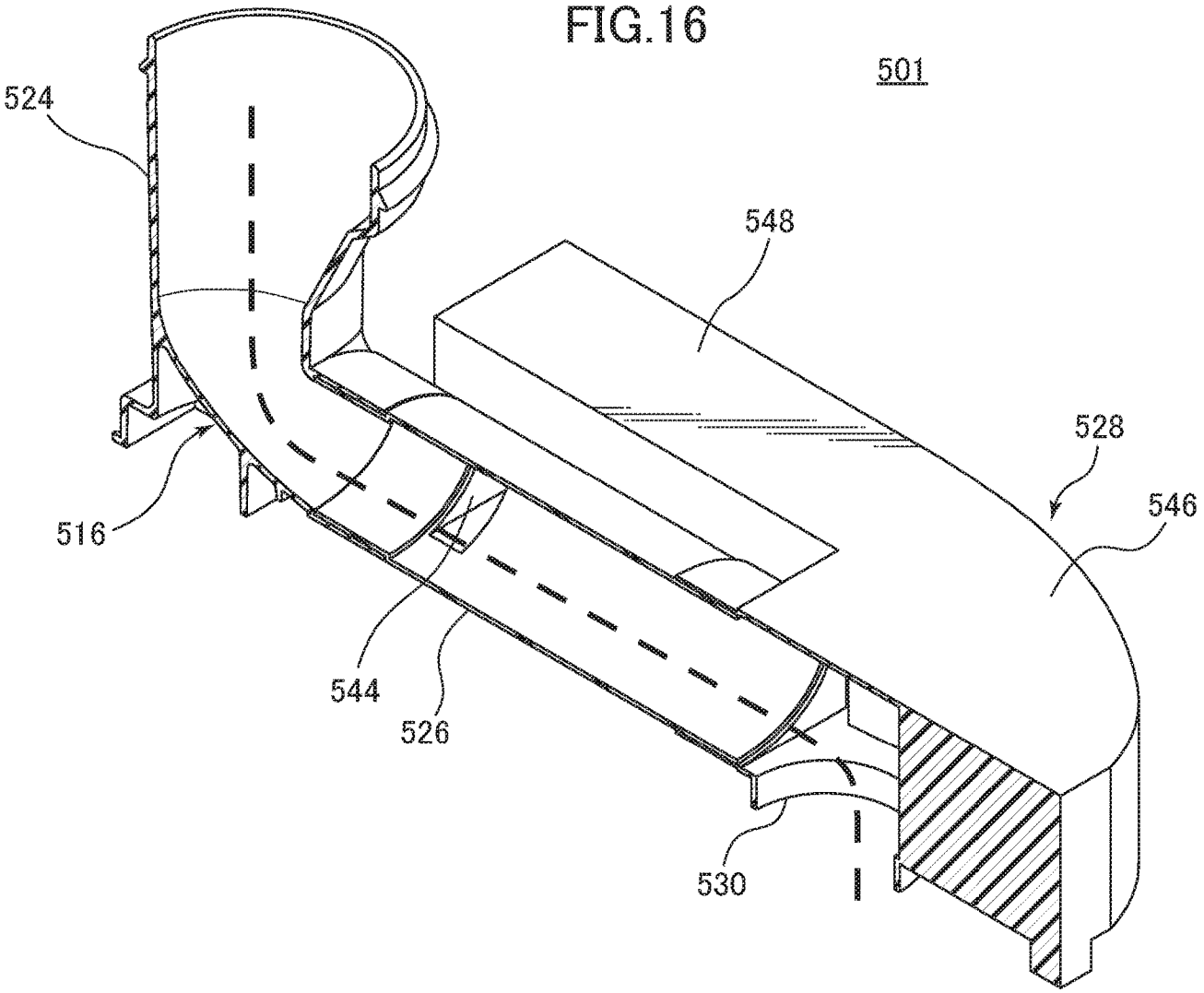
FIG. 16 is a central sectional perspective view depicting an internal structure of a discharge socket in the flush toilet according to the third embodiment.

As depicted in FIGS. 16 and 17, the delaying flow passage 528 forms a flow passage branched approximately from a forward end (downstream end) of the transverse flow passage 534 of the flow dividing section 526 in laterally opposite directions. The delaying flow passage 528 forms a flow passage in the lateral region E. The delaying flow passage 528 is disposed on a lateral side of the guide portion 532. The delaying flow passage 528 is formed bilaterally symmetrically with respect to a longitudinal axis of the toilet main unit 2. Although the delaying flow passage 528 in the third embodiment is disposed on the right and left sides with respect to the flow dividing section 526, it is to be understood that it may be disposed on only one of the right and left sides with respect to the flow dividing section 526.

The delaying flow passage 528 comprises a connection zone 546 connecting with the flow dividing section 526, and an extended flow passage 548 extending from the connection zone 546 toward the lateral region E.

The delaying flow passage 528 has an entrance 540 for accepting flush water guided along the guide portion 532. The connection zone 546 further functions as a reservoir chamber for enabling flush water having flowed thereinto from the entrance 540 to flow thereinside so as to temporarily stay therein. The entrance 540 is located on a downstream side of and on a laterally central (inward) side of the guide portion 532, and on an extension of the downstream end of the transverse flow passage 534. The delaying flow passage 528 further has an exit 544 provided separately from the connection zone 546 and configured to allow flush water having flowed into the delaying flow passage 528 to flow out therethrough. Thus, the connection zone 546 and the extended flow passage 548 form a bypass flow passage extending from the entrance 540 to the exit 544.

The connection zone 546 forms a bent flow passage for changing a flow direction of flush water having flowed thereinto from the flow dividing section 526, toward the lateral region E on a lateral side thereof. The connection zone 546 forming the bent flow passage makes it possible to reduce the flow speed of flush water flowing thereinside. Thus, by enabling flush water to flow inside the connection zone 546, it becomes possible to delay a timing at which this flush water flows through the discharge socket 516, with respect to an initial state. Based on this mechanism, the delaying flow passage 528 makes it possible for flush water having flowed thereinto along the guide portion 532 of the flow dividing section 526 to merge with a flush water flow reaching the flow dividing section 526 at a timing after the inflow of the flush water to the delaying flow passage 528, in a delayed manner. The connection zone 546 and the extended flow passage 548 are formed such that a bottom wall surface thereof is like a plane and has a flow surface slightly inclining downwardly toward the exit 544.

The extended flow passage 548 comprises a first extended flow passage 548*a* provided in one of first and second side regions of the lateral region E on both sides of a central region D, and a second extended flow passage 548*b* provided in the other side region of the lateral region E. As above, the extended flow passage 548 is provided in each of the first and second side regions of the lateral region E on both sides of the central region D. Alternatively, the extended flow passage 548 may be provided in only one of the first and second side regions of the lateral region E on both sides of the central region D. Further, although the extended flow passage 548 in the third modification is provided only in the lateral region E, the extended flow passage 548 may be provided in each of the central region D and the lateral region E. The extended flow passage 548 extends in a direction along the discharge trap pipe 8, i.e., a forward-rearward (longitudinal) direction of the toilet main unit 2. In side view, the extended flow passage 548 expands from a position corresponding to a forward side of the discharge trap pipe 8 to a position approximately beneath the fall path 8*c* of the discharge trap pipe 8. The extended flow passage 548 extends the delaying flow passage 528 in the lateral region E. The extended flow passage 548 expands the delaying flow passage 528 to a wider region in the lateral region E to increase a bottom surface area of the delaying flow passage 528. The bottom surface area of the delaying flow passage 528 is increased by the extended flow passage 548, as mentioned above. Thus, even in a situation where the flow speed of inflowing flush water is fairly low, it is possible to make it easier to enable the flush water to flow into a wider region of the delaying flow passage 528, and thus make it easier to enable the flush water to flow into the delaying flow passage 528 in a larger volume, as compared to case where the delaying flow passage 528 has a smaller bottom surface area. Thus, by forming the delaying flow passage 528 in the lateral region E to increase the bottom surface area of the delaying flow passage 528 in the lateral region E, it becomes possible to more reliably increase the volume of flush water flowing through the delaying flow passage, irrespective of the flow speed of inflowing flush water. The extended flow passage 548 additionally functions as a reservoir chamber for allowing flush water to temporarily stay therein. The extended flow passage 548 is configured to reduce the flow speed of flush water having flowed thereinto, during a course in which flush water having flowed thereinto from the connection zone 546 flows therethrough while turning back downwardly toward the position beneath the fall path 8*c*.

The exit 544 is formed separately from the entrance 540, at a position different from that of the entrance 540. The exit 544 is formed at a downstream end of the extended flow passage 548. The exit 544 comprises a first exit 544*a* forming an exit of the first extended flow passage 548*a*, and a second exit 544*b* forming an exit of the second extended flow passage 548*b*. The exit 544 is formed such that it is opened in the peripheral wall 534*a* of the transverse flow passage 534 of the flow dividing section 526. Further, the exit 544 is located upstream of the guide portion 532. The exit 544 is configured to allow flush water to flow out into the transverse flow passage 534. Thus, the delaying flow passage 528 is a bypass-type delaying flow passage in which the entrance 540 and the exit 544 are separately arranged to form a bypass flow passage for flush water. Based on the above structure, the delaying flow passage 528 makes it possible to enable flush water having flowed therein along the guide portion 532 of the flow dividing section 526 to merge with a flush water flow reaching the flow dividing section 526 at a timing after the inflow of the flush water to the delaying flow passage 528. The first extended flow passage 548*a* extending from the connection zone 546 to the first exit 544*a* and the second extended flow passage 548*b* extending from the connection zone 546 to the second exit 544*b* are formed independently of each other.

In the third embodiment, the discharge socket 516 as a discharge conduit communicated with the discharge trap pipe 8 and configured to discharge waste to the downstream building sewer pipe 22 is a resin member which is a separate component from the toilet main unit 2. However, the third embodiment may be modified to comprise a discharge conduit which is one element integrally formed with the toilet main unit 2. The toilet main unit 2 and the discharge conduit integrally formed together may be made of a ceramic material or may be made of a resin material.

With reference to FIGS. 1A, 1B and 17, an operation (function) of the flush toilet according to the third embodiment will be described below.

Specifically, a state when draining is performed along with toilet flushing in the flush toilet according to the third embodiment will be described with reference to FIGS. 1A, 1B and 17. In FIGS. 1A, 1B and 17, a flow of leading flush water, i.e., relatively low-speed flush water flowing on a leading side of waste C, is indicated by the arrowed lines A (A0, A1, A25 to A30), and a waste conveyance flow, i.e., relatively high-speed flush water mainly flowing on a trailing side of the waste C to wash down or convey the waste C, is indicated by the arrowed lines B (B0, B1, B15 to B20). The toilet main unit 2 of the flush toilet 501 according to the third embodiment is approximately the same as that of the toilet main unit 2 of the flush toilet 1 according to the first embodiment. Thus, a flow of flush water in the toilet main unit 2 of the flush toilet 501 will be described primarily with reference to FIGS. 1A and 1B. Further, in the third embodiment, the same element or component as that of the flush toilet 1 according to the first embodiment is assigned with the same reference numeral or sign, and its description will be omitted.

Firstly, a state in which relatively low-speed flush water is flowing on the leading side of the waste C will be described.

As depicted in FIG. 1A, at a start of toilet flushing, relatively low-speed flush water A flows on the leading side of the waste C, as indicated by the arrowed line A0. The relatively low-speed leading flush water A has weak momentum, and thus flows down along part of an inner peripheral surface 8*e* of the fall path 8*c* on the side of an rise path 8*b* of the discharge trap pipe 8, as indicated by the arrowed line A1.

The leading flush water A having flowed down into the upstream discharge conduit section 524 flows downwardly, and then flows into the flow dividing section 526. The leading flush water A having flowed down into the flow dividing section 526 flows transversely through the transverse flow passage 534, as indicated by the arrowed lines A25. The leading flush water A has a relatively low flow rate, so that it is more likely to spread laterally in the transverse flow passage 534. The leading flush water A flows from the peripheral wall 534*a* of the transverse flow passage 534 along the introduction surface 534*b* toward the guide portion 532, and is then guided along the guide portion 532 toward the delaying flow passage 528, as indicated by the arrowed lines A26. The leading flush water A is drawn to the guide portion 532 by the Coanda effect, so that a flow direction thereof is changed to a direction along which the guide portion 532 extends. In this way, at least part of the leading flush water A flows into the entrance 540 of the delaying flow passage 528, as indicated by the arrowed lines A27. The leading flush water A having flowed into the connection zone 546 flows from the connection zone 546 toward the extended flow passage 548, while taking a 180-degree turn to change the flow direction rearwardly, as indicated by the arrowed lines A28. The flow direction of the leading flush water A is changed to rearward direction within the connection zone 546, so that the flow speed of the leading flush water A is reduced as compared to that at a timing of the inflow to the delaying flow passage 528.

As a result of flowing through the connection zone 546 and the extended flow passage 548, the leading flush water A is delayed with respect to a flow of flush water flowing through the transverse flow passage 534 as a main flow passage. The connection zone 546 and the extended flow passage 548 form a bypass flow passage. Thus, the leading flush water A flows toward the exit 544 of the extended flow passage 548, as indicated by the arrowed lines A29. A flow distance of the leading flush water A is increased by a total flow length of the connection zone 546 and the extended flow passage 548, so that the leading flush water A is delayed with respect to a flush water flow flowing through the transverse flow passage 534 as the main flow passage. Then, the leading flush water A merge with flows in the transverse flow passage 534 through the exit 544, as indicated by the arrowed lines A30.

Secondly, a waste conveyance flow for washing down waste will be described.

As indicated by the arrowed line B0 in FIGS. 1A and 1B, a waste conveyance flow B acting to wash down the waste C flows around the waste C and mainly on the trailing side of the waste C. A main stream of the waste conveyance flow B with the waste C flows down along part of a peripheral wall of the fall path 8*c* on the side opposite to the rise path 8*b*, as indicated by the arrowed line B1. As depicted in FIG. 17, the main stream of the waste conveyance flow B with the waste C, having flowed down into the upstream discharge conduit section 524, flows downwardly as indicated by the arrowed lines B15, and then flows into the flow dividing section 526. The main stream of the waste conveyance flow B with the waste C, having flowed into the flow dividing section 526, flows transversely through the transverse flow passage 534, as indicated by the arrowed lines B16. The main stream of the waste conveyance flow B with the waste C flows down into the downstream discharge conduit section 530 according to the weight of the waste C. A part of the waste conveyance flow B with the waste C is guided to the delaying flow passage 528 along the guide portion 532, as indicated by the arrowed lines B17. The guided part of the waste conveyance flow B flows from the connection zone 546 toward the extended flow passage 548, as indicated by the arrowed lines B18, and further flows into the transverse flow passage 534 through the exit 544, as indicated by the arrowed lines B19.

As above, the leading flush water A and a part of the waste conveyance flow B flowing out to the transverse flow passage 534 through the exit 544 merge with a subsequent waste conveyance flow B. Thus, the leading flush water A and the waste conveyance flow B having flowed into the delaying flow passage 528 merge with a subsequent waste conveyance flow B reaching the transverse flow passage 534 of the flow dividing section 526 at a timing after a given time has elapsed since the inflow of the leading flush water A and the waste conveyance flow B to the delaying flow passage 528. That is, parts of the leading flush water A and a part of the waste conveyance flow B having flowed into the delaying flow passage 528 are converted to a subsequent waste conveyance flow B.

This makes it possible to add the leading flush water A contributing less to conveyance of the waste C, to the waste conveyance flow B, and thus increase the volume of the waste conveyance flow B as indicated by the arrowed lines B20, thereby improving a capability of conveying the waste C (waste conveyance capability). The arrowed lines B20 indicate the waste conveyance flow B which is increased in terms of flow rate and/or volume based on merging of the leading flush water A and the waste conveyance flow B.

The waste conveyance flow B with the waste C flows toward the downstream discharge conduit section 530, and is then discharged into the building sewer pipe 22.

In the flush toilet 501 according to the third embodiment, during toilet flushing, the flow dividing section 526 enables at least part of relatively low-speed flush water flowing on the leading side of the waste (leading flush water) to flow into the delaying flow passage 528, and the delaying flow passage 528 enables flush water having flowed thereinto to merge with a flow of the relatively high-speed flush water for washing down or convey the waste (waste conveyance flow), which reaches the flow dividing section 526 at a timing after the inflow of the flush water to the delaying flow passage 528. In this process, the delaying flow passage 528 forms a flow passage in the lateral region E between the discharge trap pipe 8 and the skirt portion 9, so that it is possible to expand the delaying flow passage 528 to a wider region on the side of the lateral region E to increase the bottom surface area of the delaying flow passage 528. This can make it easier to enable the leading flush water to flow into the delaying flow passage 528 in a larger volume. Therefore, even in a situation where the volume of flush water is reduced in order to cope with demand for water-saving, the flush toilet 501 according to the third embodiment can enable the leading flush water to flow out through the delaying flow passage 528 in a larger volume so as to merge with the waste conveyance flow, i.e., can increase the volume of the waste conveyance flow, thereby improving a capability of conveying waste (waste conveyance capability).

In the case where, due to difficulty in forming the delaying flow passage 528 in the lateral region, the delaying flow passage is formed only in the central region D, i.e., it is impossible to increase the bottom surface area toward a lateral side, it is conceivable to form the delaying flow passage 528 in such a manner as to expand an internal space thereof in an upward-downward direction, to thereby increase the volume of flush water flowing through the delaying flow passage. In this case, however, when the flow speed of flush water flowing into the delaying flow passage 528 is fairly small, it is difficult to raise a water level, i.e., increase the volume of flush water flowing through the delaying flow passage 528. In the flush toilet 501 according to the third embodiment, by forming the delaying flow passage 528 in the lateral region E to increase the bottom surface area of the delaying flow passage 528 in the lateral region E, it becomes possible to more reliably increase the volume of flush water flowing through the delaying flow passage 528, irrespective of the flow speed of inflowing flush water. This makes it possible to enable the leading flush water to flow out through the delaying flow passage 528 in a larger volume so as to merge with the waste conveyance flow.

In the flush toilet 501 according to the third embodiment, the connection zone 546 enables the flow direction of flush water having flowed thereinto from the flow dividing section 526 to be changed toward the lateral region E, so that it is possible to reduce the flow speed of the leading flush water flowing through the extended flow passage 548, and increase a period of time during which the leading flush water flows through the extended flow passage 548. This makes it possible to suppress a situation where the leading flush water having flowed into the delaying flow passage 528 flows out to the flow dividing section 526 before the waste conveyance flow reaches the flow dividing section 526. Thus, it becomes possible to enable the leading flush water to flow out through the delaying flow passage 528 in a larger volume so as to more reliably merge with the waste conveyance flow B.

In the flush toilet 501 according to the third embodiment, the extended flow passage 548 provided in each of the first and second side regions of the lateral region E on both lateral sides of the central region D can expand the delaying flow passage 528 to a wider region on the side of the lateral region E to increase the bottom surface area of the delaying flow passage 528. This can make it easier to enable the leading flush water to flow into the delaying flow passage (28, 128, 228, 428, 528) in a larger amount.

In the flush toilet 502 according to the third embodiment, the extended flow passage 548 extends in a direction along the direction connecting the inlet 8*f* and the outlet 8*d* of the discharge trap pipe 8, so that it is possible to expand the delaying flow passage 528 to a wider region on the side of the lateral region E to further increase the bottom surface area of the delaying flow passage 528. This can make it easier to enable the leading flush water to flow into the delaying flow passage 528 in a larger amount.

In the flush toilet 501 according to the third embodiment, differently from the structure in which the connection zone 546 additionally function as an exit 544 of the delaying flow passage 528, it is possible to suppress a situation where a non-flowing state of flush water within the extended flow passage 548 continues for a relatively long period of time. More specifically, it is possible to suppress the occurrence of a situation where a non-flowing state of flush water within the extended flow passage 548 continues for a relatively long period of time and thus a timing of the outflow is delayed to an extent that the flush water cannot merge with the waste conveyance flow. Thus, even when the volume of flush water for toilet flushing is reduced in order to cope with demand for water-saving, it is possible to enable the leading flush water to flow out through the delaying flow passage 528 in a larger volume so as to merge with the conveyance flow. This makes it possible to increase the volume of the waste conveyance flow, thereby improving the waste conveyance capability. Further, it becomes possible to suppress a situation where, due to the non-flowing state of flush water within the extended flow passage 548, floating pieces of waste sink in the flush water and remain in the extended flow passage 548.

In the flush toilet 501 according to the third embodiment, the first extended flow passage 548*a* extending from the connection zone 546 to the first exit 544*a* and the second extended flow passage 548*b* extending from the connection zone 546 to the second exit 544*b* are formed independently of each other. This makes it possible to suppress a situation where a turbulent flow occurs due to merging of respective flush water flows in the first and second extended flow passages 548*a*, 548*b*, and the non-flowing state of flush water within the extended flow passages 548*a*, 548*b* continues for a relatively long period of time.

In the flush toilet 501 according to the third embodiment, the discharge socket 516 is a resin member which is a separate component from the toilet main unit 2. Thus, for example, comparing with case where the discharge socket is made of a ceramic material, it becomes possible to reduce a manufacturing error, and more reliably install the delaying flow passage 528 in the lateral region E.

In the flush toilet 501 according to the third embodiment, the extended flow passage 548 is provided only in the lateral region E. The extended flow passage 548 disposed in the lateral region E becomes less likely to receive restrictions from the shape of the discharge trap pipe 8 and the position of an inlet of the building sewer pipe 22 to be connected to the discharge socket 516. Thus, according to this feature, it becomes possible to apply the extended flow passage 548 to various types of flush toilets adaptable to differences in the shape of the discharge trap pipe 8 and the position of the inlet of the building sewer pipe 22.

It should be noted that the present invention is not limited to the above embodiment, but various modifications and changed may be made therein. For example, a flow dividing section and a delaying flow passage of the discharge socket in the flush toilet according to any one of the embodiments of the present invention are usable in a situation where the discharge trap pipe of the toilet main unit has various shapes, and/or the building sewer pipe is set at various positions.

Figure 18A:
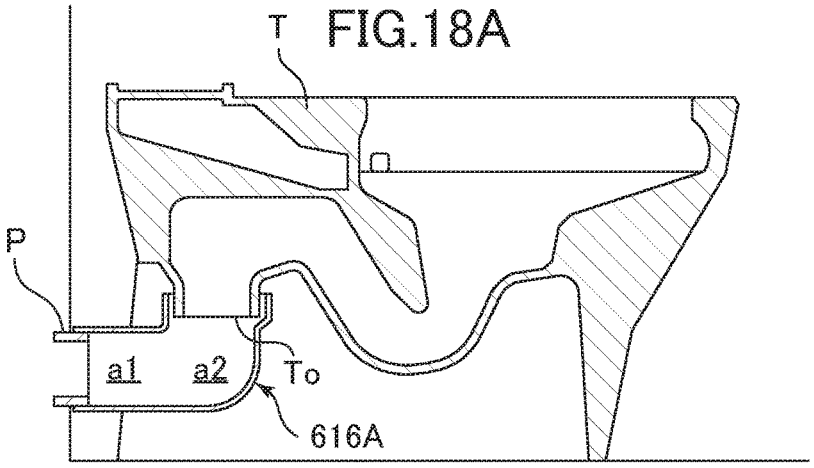
FIG. 18A is a sectional view depicting a first type of flush toilet in which a flow dividing section and a delaying flow passage of the discharge socket in the flush toilet according to at least one of the embodiments of the present invention are suitably usable, wherein the first type of flush toilet comprises a discharge trap pipe opened to face a floor, and a discharge socket to be connected to a building sewer pipe extending from a building wall.
Figure 18B:
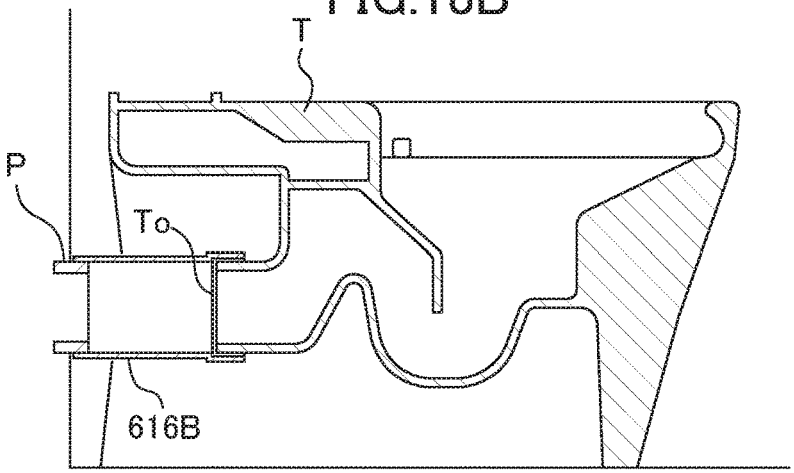
FIG. 18B is a sectional view depicting a second type of flush toilet in which a flow dividing section and a delaying flow passage of the discharge socket in the flush toilet according to at least one of the embodiments of the present invention are suitably usable, wherein the second type of flush toilet comprises a discharge trap pipe opened to face a building wall, and a discharge socket to be connected to a building sewer pipe extending from the building wall.
Figure 18C:
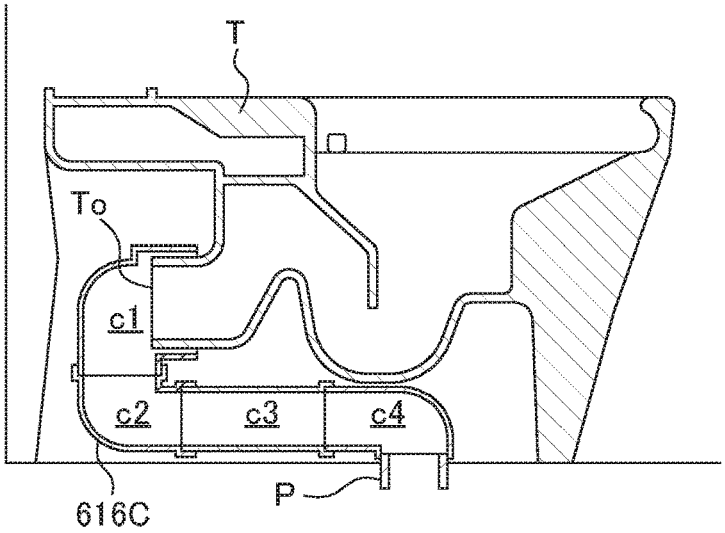
FIG. 18C is a sectional view depicting a third type of flush toilet in which a flow dividing section and a delaying flow passage of the discharge socket in the flush toilet according to at least one of the embodiments of the present invention are suitably usable, wherein the third type of flush toilet comprises a discharge trap pipe opened to face a building wall, and a discharge socket to be connected to a building sewer pipe extending from a floor.

FIG. 18A is a sectional view depicting a first type of flush toilet in which the flow dividing section and the delaying flow passage of the discharge socket in the flush toilet according to at least one of the embodiments of the present invention are suitably usable, wherein the first type of flush toilet comprises a discharge trap pipe opened to face a floor, and a discharge socket to be connected to a building sewer pipe extending from a building wall. FIG. 18B is a sectional view depicting a second type of flush toilet in which the flow dividing section and the delaying flow passage of the discharge socket in the flush toilet according to at least one of the embodiments of the present invention are suitably usable, wherein the second type of flush toilet comprises a discharge trap pipe opened to face a building wall, and a discharge socket to be connected to a building sewer pipe extending from the building wall. FIG. 18C is a sectional view depicting a third type of flush toilet in which the flow dividing section and the delaying flow passage of the discharge socket in the flush toilet according to at least one of the embodiments of the present invention are suitably usable, wherein the third type of flush toilet comprises a discharge trap pipe opened to face a building wall, and a discharge socket to be connected to a building sewer pipe extending from a floor.

As depicted in FIG. 18A, there is a situation where a discharge socket 616A connecting a toilet main unit T and a building sewer pipe P is formed in an approximately L shape in side view.

In this situation, the discharge socket 616A may be divided into a transverse section a1 communicable with a building sewer pipe P and extending in a transverse direction, and an approximately L-shaped bent section a2 communicable between the transverse section a1 and an outlet To of a vertically downwardly-extending discharge trap pipe of a toilet main unit T.

As one example, in the discharge socket 616A having the above shape, the flow dividing section 426 and the delaying flow passage 428 described in the second embodiment are suitably usable in the transverse section a1. As another example, in the discharge socket 616A, the flow dividing section 26 and the delaying flow passage (28, 228) in the first embodiment are suitably usable in the bent section a2.

As depicted in FIG. 18B, there is a situation where a discharge socket 616B connecting a toilet main unit T and a building sewer pipe P is formed as an transverse pipe communicable between the building sewer pipe P and an outlet To of a transversely-extending discharge trap pipe of the toilet main unit T. As one example, in the discharge socket 616B having the above shape, the flow dividing section 426 and the delaying flow passage 428 described in the second embodiment are suitably usable in the transverse pipe.

As depicted in FIG. 18C, there is a situation where a discharge socket 616C connecting a toilet main unit T and a building sewer pipe P is formed in an approximately S shape in side view.

In this situation, the discharge socket 616C may be divided into: an approximately L-shaped first bent section c1 communicable with a horizontally-opened outlet To of a discharge trap pipe of a toilet main unit T; an approximately L-shaped second bent section c2 having one end communicable with the first bent section c1 and extending vertically and the other end extending horizontally; a transverse section c3 communicable with the second bent section c2 and extending transversely; and a third bent section c4 having one end communicable with the transverse section c3 and the other end communicable with a vertically-extending building sewer pipe P.

As one example, in the discharge socket 616C, the flow dividing section 26 and the delaying flow passage (28, 228) in the first embodiment are suitably usable in the first bent section c1 and the second bent section c2. As another example, in the discharge socket 616C, the flow dividing section 426 and the delaying flow passage 428 described in the second embodiment are suitably usable in the transverse section c3. As still another example, in the discharge socket 616C, the flow dividing section 526 and the delaying flow passage 528 in the third embodiment are suitably usable in the third bent section c4.

What is claimed is:

1. A flush toilet designed to be flushed using flush water to discharge waste, comprising:

a toilet main unit comprising a bowl portion for receiving waste, a discharge trap pipe extending from a bottom of the bowl portion, and a skirt portion provided to cover the bowl portion and the discharge trap pipe from a lateral side thereof; and a discharge conduit communicated with the discharge trap pipe, the discharge conduit comprising:

an upstream discharge conduit section;

a flow dividing section provided on a downstream side of the upstream discharge conduit section;

a downstream discharge conduit section provided on a downstream side of the flow dividing section; and a delaying flow passage branched from the flow dividing section, wherein:

an inward region of the skirt portion comprises:

a central region extending along a direction connecting the inlet and the outlet of the discharge trap pipe and defined between a width of the discharge trap pipe in a direction orthogonal to the direction connecting the inlet and the outlet of the discharge trap pipe in top plan view; and a lateral region defined in a lateral side of the central region in the direction orthogonal to the direction connecting the inlet and the outlet of the discharge trap pipe in top plan view; and the delaying flow passage of the discharge conduit is formed at least in the lateral region in the skirt portion and merges flush water having flowed into the delaying flow passage from the flow dividing section with a flush water flow reaching the flow dividing section at a timing after the inflow of the flush water to the delaying flow passage.

2. The flush toilet as defined in claim 1, wherein the delaying flow passage comprises a connection zone connecting with the flow dividing section, and an extended flow passage extending from the connection zone toward the lateral region, wherein the connection zone forms a bent flow passage for changing a flow direction of flush water having flowed into the connection zone from the flow dividing section, toward the lateral region.

3. The flush toilet as defined in claim 2, wherein the extended flow passage is provided in each of a first side region and a second side region of the lateral region on both lateral sides of the central region.

4. The flush toilet as defined in claim 2, wherein the extended flow passage extends in a direction along the direction connecting the inlet and the outlet of the discharge trap pipe.

5. The flush toilet as defined in claim 3, wherein, in side view, the extended flow passage extends to reach a position where the extended flow passage partially overlaps the discharge trap pipe.

6. The flush toilet as defined in claim 2, wherein the flow dividing section of the discharge conduit forms a downward flow passage extending in an upward-downward direction, and wherein the connection zone of the delaying flow passage is connected to part of the downward flow passage of the flow dividing section on the side of an rise path of the discharge trap pipe.

7. The flush toilet as defined in claim 2, wherein the delaying flow passage has an exit separately from the connection zone, wherein the delaying flow passage merge flush water having flowed into the delaying flow passage from the connection zone, from the exit with a flush water flow reaching the flow dividing section at a timing after the inflow of the flush water to the delaying flow passage.

8. The flush toilet as defined in claim 3, wherein:

the delaying flow passage has an exit separately from the connection zone, wherein the delaying flow passage merge flush water having flowed into the delaying flow passage from the connection zone, from the exit with a flush water flow reaching the flow dividing section at a timing after the inflow of the flush water to the delaying flow passage; and the extended flow passage comprises a first extended flow passage provided in one of the first and second side regions of the lateral region, and a second extended flow passage provided in the other side region of the lateral region, and wherein the exit comprises a first exit forming an exit of the first extended flow passage, and a second exit forming an exit of the second extended flow passage, and wherein the first extended flow passage extending from the connection zone to the first exit and the second extended flow passage extending from the connection zone to the second exit are formed independently of each other.

9. The flush toilet as recited in claim 2, wherein the discharge conduit is a resin member which is a separate component from the toilet main unit.

10. The flush toilet as recited in claim 9, wherein the extended flow passage is provided only in the lateral region.

11. The flush toilet as recited in claim 10, wherein the downstream discharge conduit section comprises a transverse flow passage extending in a transverse direction to a position corresponding to a building sewer pipe, and wherein the connection zone and an exit of the delaying flow passage are opened to the flow dividing section located upstream of the transverse flow passage of the downstream discharge conduit section.

* * * * *